US009655450B2

(12) United States Patent
Marshall et al.

(10) Patent No.: US 9,655,450 B2
(45) Date of Patent: May 23, 2017

(54) WALL PROXIMITY FURNITURE MEMBER RECLINING MECHANISM

(71) Applicant: La-Z-Boy Incorporated, Monroe, MI (US)

(72) Inventors: Richard E. Marshall, Monroe, MI (US); Eugene Cole, II, Maumee, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 197 days.

(21) Appl. No.: 14/660,144

(22) Filed: Mar. 17, 2015

(65) Prior Publication Data

US 2016/0270537 A1 Sep. 22, 2016

(51) Int. Cl.
*A47C 1/035* (2006.01)
*A47C 1/0355* (2013.01)

(52) U.S. Cl.
CPC ..... *A47C 1/0355* (2013.01); *A47C 1/0352* (2013.01)

(58) Field of Classification Search
CPC ..... A47C 1/0347; A47C 1/0352
See application file for complete search history.

(56) References Cited

U.S. PATENT DOCUMENTS 3,758,151 A * 9/1973 Re ..... A47C 1/0342 297/259.2
4,099,776 A * 7/1978 Crum ..... A47C 1/0347 297/329
4,140,342 A * 2/1979 Jones ..... A47C 3/027 297/267.1
4,216,992 A * 8/1980 Crum ..... A47C 1/0355 297/344.15
4,226,468 A * 10/1980 Johnson ..... A47C 1/0347 297/68
4,367,895 A 1/1983 Pacitti et al.
(Continued)

FOREIGN PATENT DOCUMENTS

WO 2012162499 A1 11/2012

OTHER PUBLICATIONS

Written Opinion of the International Searching Authority for application No. PCT/US2016/021361 dated May 30, 2016.
(Continued)

*Primary Examiner* — Timothy J Brindley
(74) *Attorney, Agent, or Firm* — Harness, Dickey & Pierce, P.L.C.

(57) ABSTRACT

A furniture member may include a base assembly, a frame assembly and a tilt mechanism. The base assembly includes rails having a track and a stop plug received in the track. The frame assembly includes a base frame, a seatback frame and a seat bottom frame. The seatback frame is rotatably coupled to the base frame. The seat bottom frame is coupled to the seatback frame such that rotation of the seatback frame causes movement of the seat bottom frame relative to the seatback frame and the base frame. The tilt mechanism is coupled to the seat bottom frame and engages the tracks such that rotation of the seatback frame relative to the base frame causes bearings of the tilt mechanism to slide along the tracks, thereby translating the base frame relative to the base assembly. The bearings contact stop plugs when the seatback is in a fully reclined position.

38 Claims, 24 Drawing Sheets

(56) References Cited

U.S. PATENT DOCUMENTS

| | | | | | |
|---|---|---|---|---|---|
| 5,064,244 | A * | 11/1991 | Sproule | A47C 1/0352 | 297/188.19 |
| 5,072,988 | A * | 12/1991 | Plunk | A47C 1/0355 | 297/68 |
| 5,141,284 | A | 8/1992 | LaPointe | | |
| 5,147,108 | A * | 9/1992 | LaPointe | A47C 1/03294 | 297/318 |
| 5,156,441 | A | 10/1992 | Byersmith et al. | | |
| 5,234,253 | A | 8/1993 | LaPointe et al. | | |
| 5,570,927 | A * | 11/1996 | LaPointe | A47C 1/0355 | 297/318 |
| 5,971,475 | A * | 10/1999 | Lawson | A47C 1/0355 | 297/68 |
| 2005/0067867 | A1 | 3/2005 | May | | |
| 2006/0061147 | A1 * | 3/2006 | Johnson | A47C 1/0352 | 297/85 L |
| 2013/0140855 | A1 | 6/2013 | Murphy et al. | | |
| 2014/0070585 | A1 | 3/2014 | LaPointe | | |
| 2014/0333099 | A1 | 11/2014 | Lu et al. | | |
| 2016/0100687 | A1 * | 4/2016 | Murphy | A47C 1/0347 | 297/271.3 |

OTHER PUBLICATIONS

International Search Report for application No. PCT/US2016/021361 dated May 30, 2016.

* cited by examiner

WALL PROXIMITY FURNITURE MEMBER RECLINING MECHANISM

FIELD

The present disclosure relates to a reclining mechanism for a furniture member.

BACKGROUND

This section provides background information related to the present disclosure and is not necessarily prior art.

Conventional reclining chairs or sofas must be positioned far enough away from a wall or any other object in a room to provide enough space behind the chair or sofa so that the wall does not restrict the ability of a seatback of the chair or sofa to move into a fully reclined position. This can result in the user having to position the chair or sofa farther away from the wall than he or she would choose to position a non-reclining chair or sofa in order to leave space for the seatback to fully recline. The present disclosure provides a furniture member that translates a frame assembly of the furniture member forward as the seatback reclines, such that a distance between the wall and the seatback is the same or nearly the same in both an upright position and in a fully reclined position.

SUMMARY

This section provides a general summary of the disclosure, and is not a comprehensive disclosure of its full scope or all of its features.

In one form, the present disclosure provides a furniture member may include a base assembly, a frame assembly and a tilt mechanism. The base assembly may include a pair of rails extending parallel to each other between front and rear portions of the base assembly. Each of the rails may include a track and a stop plug at least partially received in a front end of the track. The frame assembly may include a chair body or base frame, a seatback frame and a seat bottom frame. The seatback frame may be rotatably coupled to the base frame. The seat bottom frame may be movably coupled to the seatback frame such that rotation of the seatback frame causes corresponding movement of the seat bottom frame relative to the seatback frame and the base frame. The tilt mechanism may support the base frame and may be coupled to the seat bottom frame. The tilt mechanism may include drive links and side plates that slidably engage the tracks such that rotation of the seatback frame relative to the base frame causes the drive links and side plates to slide along the tracks, thereby translating the base frame relative to the base assembly. Each of the side plates may include a bearing that contacts one of the stop plugs when the seatback is in a fully reclined position.

In some configurations, a pair of base stop members are fixedly attached to the base frame. The base stop members may be spaced apart from the stop plugs when the seatback is in the fully reclined position and abut the stop plugs when the seatback is in an upright position.

In some configurations, a side stop member is fixed relative to each of the base stop members. Interference between side stop members and the tracks restricts relative lateral movement between the base frame and the base assembly.

In some configurations, each base stop member includes first and second legs forming an L-shaped profile. Both of the first and second legs may contact the corresponding stop plug.

In some configurations, the base frame tilts relative to the base assembly as the base frame translates relative to the base assembly.

In some configurations, the furniture member includes a legrest mechanism that is movable between extended and retracted positions independently of movement of the seatback relative to the base frame.

In some configurations, the furniture member includes a first linear actuator and a second linear actuator. The first linear actuator powers movement of the tilt mechanism. The second linear actuator powers movement of the legrest mechanism.

In some configurations, the first linear actuator powers rotation of the seatback frame relative to the base frame.

In some configurations, the first linear actuator powers movement of the seat bottom frame relative to the base frame.

In some configurations, the first and second linear actuators are aligned with each other and with an axis that extends vertically upward from a support surface upon which the furniture member is situated for normal use. The axis may be perpendicular to the support surface.

In some configurations, actuation of only the second linear actuator while the seatback is in an upright position to move the legrest mechanism from the retracted position to the extended position causes the seatback and the base frame to tilt rearward relative to the base assembly from the upright position to a pre-tilt position.

In some configurations, the furniture member includes a first switch controlling operation of the first actuator independently from the second actuator, a second switch controlling operation of the second actuator independently of the first actuator, and a third switch controlling simultaneous actuation of the first and second actuators.

In some configurations, the furniture member is a motion sofa having a plurality of seat sections, each of which including a base assembly, a frame assembly and a tilt mechanism. The tilt mechanism of the seat sections may be movable independently of each other.

In other configurations, the furniture member could be a chair, loveseat, sectional, or any other motion furniture product.

In another form, the present disclosure provides a furniture member that may include a base assembly, a frame assembly, a tilt mechanism and a pair of base stop members. The base assembly may include a pair of rails extending parallel to each other between front and rear portions of the base assembly. The frame assembly may include a base frame, a seatback frame and a seat bottom frame. The seatback frame may be rotatably coupled to the base frame. The seat bottom frame may be movably coupled to the seatback frame such that rotation of the seatback frame causes corresponding movement of the seat bottom frame relative to the seatback frame and the base frame. The tilt mechanism supports the base frame and is coupled to the seat bottom frame. The tilt mechanism may include bearings that movably engage the tracks such that rotation of the seatback frame relative to the base frame causes the bearings to move along the tracks, thereby translating the base frame relative to the base assembly. The base stop members may be fixedly attached to the base frame. The base stop members may be spaced apart from the rails when the seatback is in the fully reclined position and may abut the rails when the seatback is in an upright position. Each of the base stop members may include a side stop member fixed relative thereto. Interference between side stop members and the tracks restricts relative lateral movement between the base frame and the base assembly.

In some configurations, each of the rails includes a track and a stop plug at least partially received in a front end of the track.

In some configurations, the bearings contact the stop plugs when the seatback is in a fully reclined position.

In some configurations, each base stop member includes first and second legs forming an L-shaped profile. Both of the first and second legs may contact a corresponding stop plug.

In some configurations, the base frame tilts relative to the base assembly as the base frame translates relative to the base assembly.

In some configurations, the furniture member includes a legrest mechanism that is movable between extended and retracted positions independently of movement of the seatback relative to the base frame.

In some configurations, the furniture member includes a first linear actuator and a second linear actuator. The first linear actuator powers movement of the tilt mechanism. The second linear actuator powers movement of the legrest mechanism.

In some configurations, the first and second linear actuators are aligned with each other and with an axis that extends vertically upward from a support surface upon which the furniture member is situated for normal use. The axis may be perpendicular to the support surface.

In some configurations, the first linear actuator powers rotation of the seatback frame relative to the base frame.

In some configurations, the first linear actuator powers movement of the seat bottom frame relative to the base frame.

In some configurations, the furniture member is a motion sofa having a plurality of seat sections, each of which including a base assembly, a frame assembly and a tilt mechanism. The tilt mechanism of the seat sections may be movable independently of each other.

In other configurations, the furniture member could be a chair, loveseat, sectional, or any other motion furniture product.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
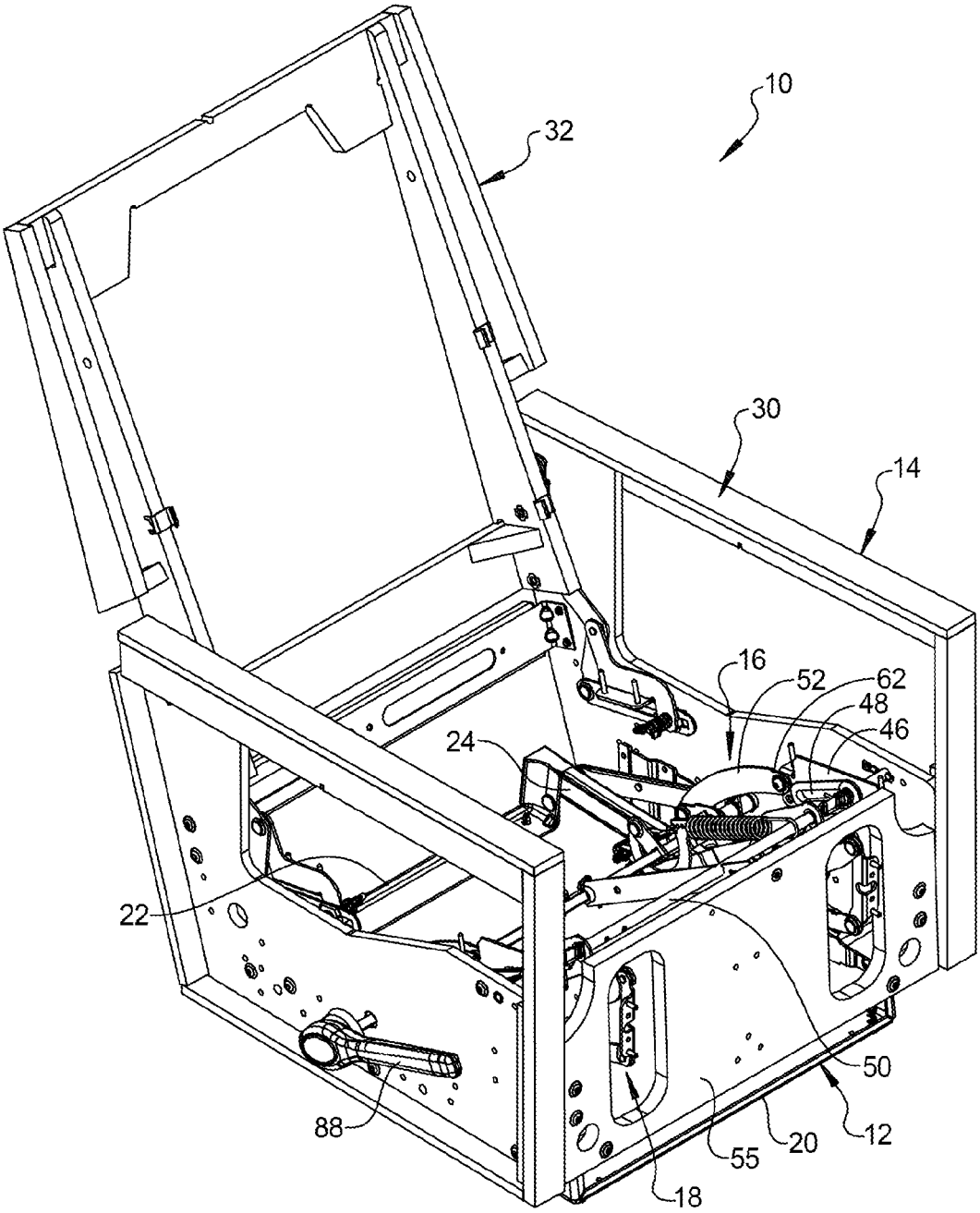
FIG. 1 is a perspective view of a furniture member in an upright position according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
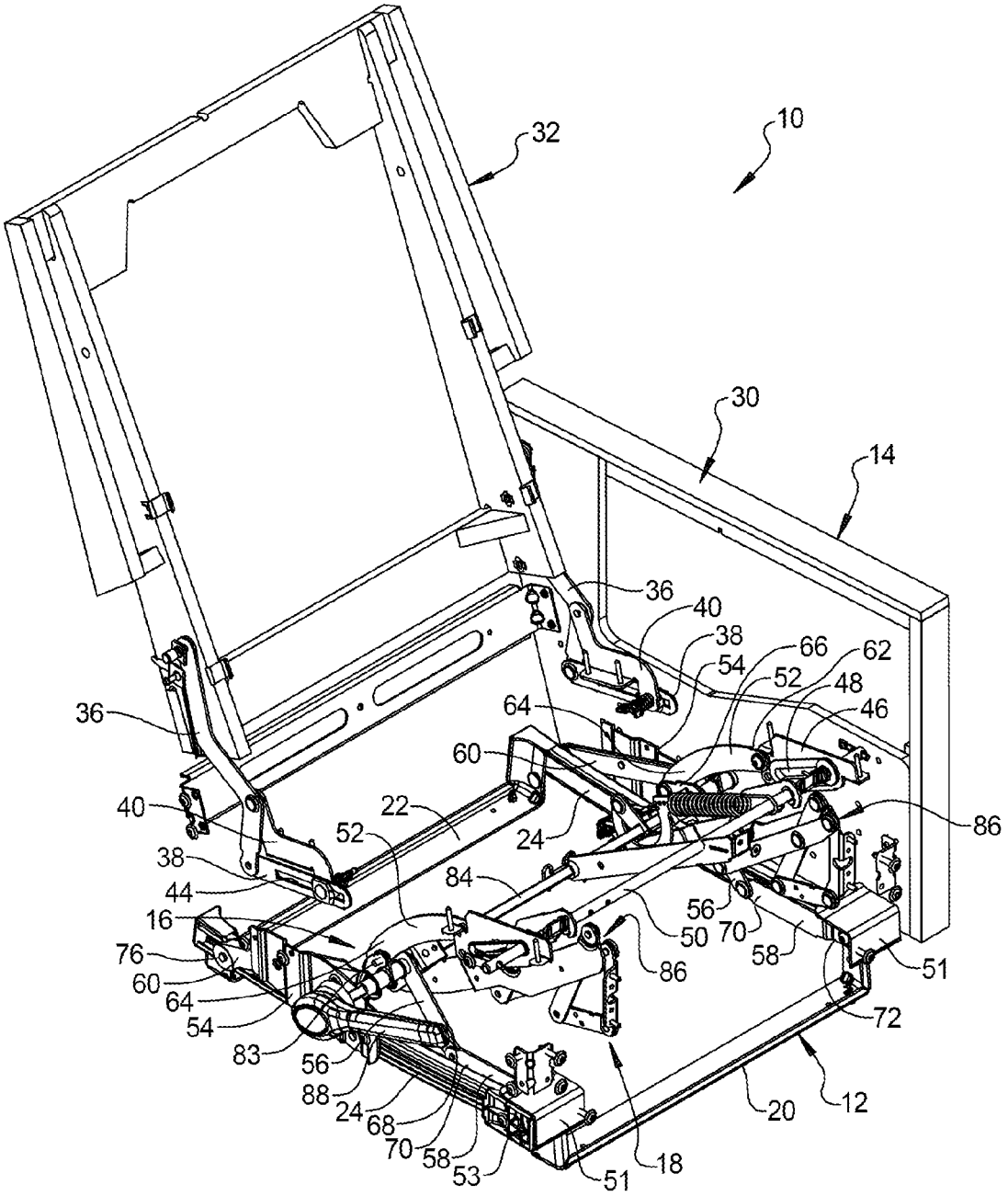
FIG. 2 is another perspective view of the furniture member in the upright position with portions of a frame of the furniture member removed for clarity.
Figure 3:
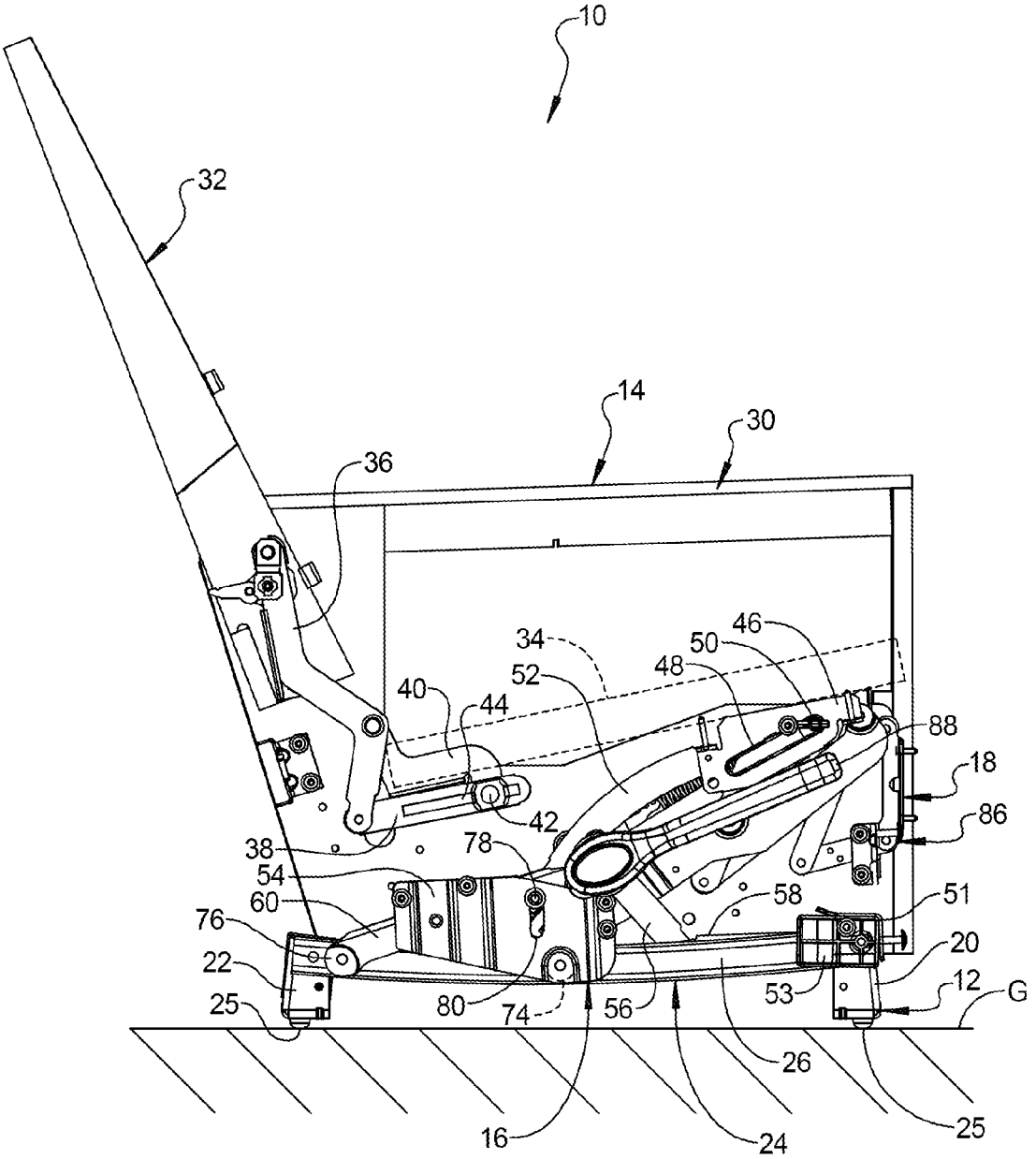
FIG. 3 is a side view of the furniture member in the upright position with portions of the frame removed for clarity.

With reference to FIGS. 1-17, a furniture member 10 is provided that may include a base assembly 12 (FIG. 2), a frame assembly 14 (FIG. 1), a tilt mechanism 16 (FIGS. 2 and 3), and a legrest mechanism 18 (FIGS. 2 and 3). The base assembly 12 supports the frame assembly 14 and the tilt and legrest mechanisms 16, 18 and allows movement of the frame assembly 14 and the tilt and legrest mechanisms 16, 18 while the base assembly 12 remains stationary relative to a support surface or ground G (FIG. 3) upon which the furniture member 10 is situated. As will be described in more detail below, the frame assembly 14 and the tilt mechanism 16 are movable relative to the base assembly 12 among an upright position (FIGS. 1-6), a pre-tilt position (FIGS. 7-11) and a fully reclined position (FIGS. 12-16). The legrest mechanism 18 is movable relative to the base assembly 12 and the frame assembly 14 between a retracted position (FIGS. 1-6) and an extended position (FIGS. 7-16). It will be appreciated that the frame assembly 14 and tilt mechanism 16 can be moved into the fully reclined position without moving the legrest mechanism 18 into the extended position.

Figure 4:
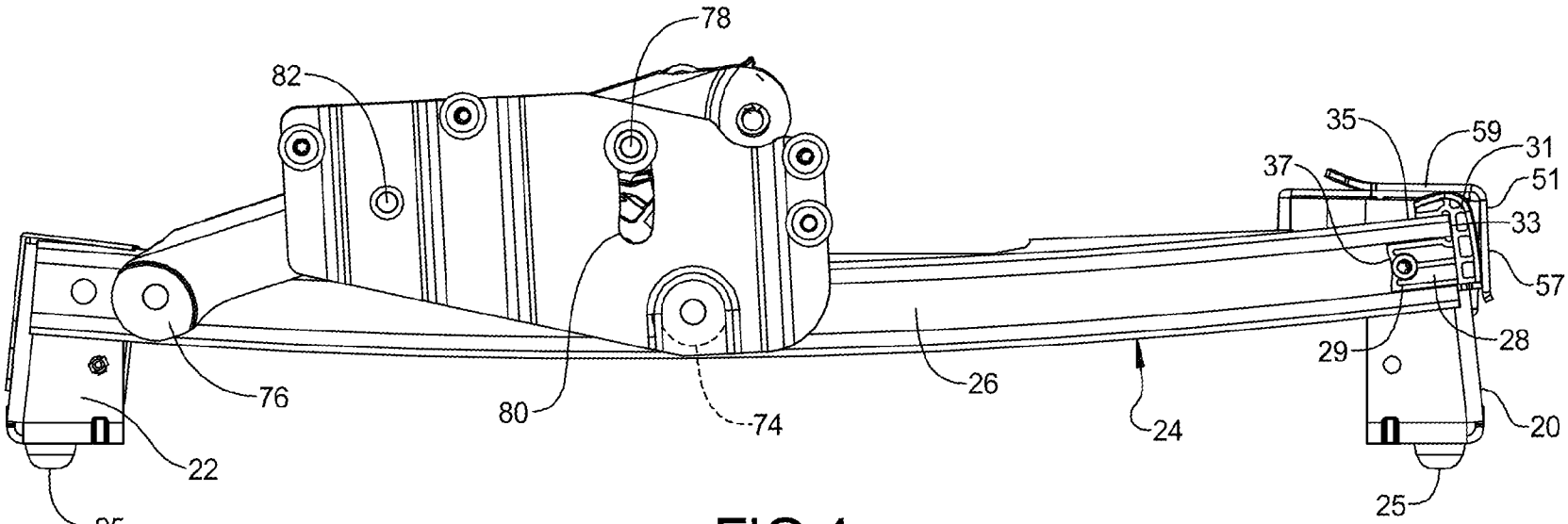
FIG. 4 is a side view of a portion of a tilt mechanism and base assembly of the furniture member in the upright position.

The base assembly 12 may include a front support member 20, a rear support member 22, and a pair of rails 24. The front and rear support members 20, 22 can include a plurality of feet 25 that contact the support surface G. The rails 24 extend parallel to each other between the front and rear support members 20, 22 and are fixedly attached to the front and rear support members 20, 22. Each of the rails 24 includes a curved track channel 26 that may extend through an entire length of the rail 24. A stop plug 28 (FIGS. 4 and 17) may be at least partially received in a front end of each track channel 26. The stop plugs 28 may be press fit into the track channels 26 and/or otherwise fixed to the rails 24. Each stop plug 28 may include a body portion 29 received in the track channel 26 and a flange portion 31 disposed outside of the track channel 26. The body portion 29 can include a curved end surface 37 (FIG. 4) that may contact a front bearing 74 of the tilt mechanism 16 when the furniture member 10 is in the fully reclined position. In some configurations, the radius of curvature of the surface 37 may be sized to match that of the front bearing 74. The body and flange portions 29, 31 can be integrally formed with each other as a unitary body. As shown in FIG. 4, the flange portion 31 may extend around and at least partially cover a front end 33 of the rail 24 and a portion of a longitudinal side 35 of the rail 24.

The frame assembly 14 may include a chair body or base frame 30, a seatback frame 32 and a seat bottom frame 34 (FIG. 3). The seatback frame 32 is rotatable relative to the base frame 30 and the seat bottom frame 34 between the upright position and the fully reclined position. The seatback frame 32 is pivotably coupled to the base frame 30 by a pair of swing links 36. Each swing link 36 is pivotably coupled to a friction link 38 and a rear arm 40. The rear arms 40 include fasteners 42 that slidably engage slots 44 in the friction links 38. The seat bottom frame 34 is supported by the rear arms 40 and a pair of front arms 46. Each front arm 46 includes a slot 48. The slots 48 in the front arms 46 slidably engage a support rod 50 attached to the base frame 30.

The rear arms 40 and the front arms 46 cooperate to support the seat bottom frame 34. When the seatback frame 32 rotates relative to the base frame 30 between the upright and reclined positions, the slots 44 of the friction links 38 slide along the fasteners 42, and the slots 48 in the front arms 46 slide along the support rod 50, thereby moving the seat bottom frame 34 forward relative to the base frame 30 (compare FIGS. 3 and 15).

The frame assembly 14 may also include a pair of base stop members 51 and a pair of side stop members 53. The base stop members 51 may be fixedly attached to a front board 55 (FIGS. 1, 10 and 15) of the base frame 30. The base stop members 51 may include generally L-shaped profiles. The base stop members 51 may each include first and second legs 57, 59 that are approximately perpendicular to each other or angled relative to each other to form the generally L-shaped profile of the base stop member 51. The side stop members 53 may be fixedly attached to the base stop members 51 and/or to the base frame 30.

The tilt mechanism 16 includes a pair of upper connecting links 52, a pair of side plates 54, a pair of upper front drive links 56, a pair of lower front drive links 58, a pair of rear drive links 60. The upper connecting links 52 are pivotably connected at a first end 62 to the front arms 46 supporting the seat bottom frame 34. The upper connecting links 52 are pivotably connected at a second end to a first end of the upper front drive links 56. A second end of each upper front drive link 56 is pivotably coupled to a first end of each lower front drive link 58. A second end of each lower front drive link 58 is pivotably coupled to a corresponding one of the rails 24 of another part of the base assembly 12.

As shown in FIGS. 3 and 4, the side plates 54 are fixedly attached to the base frame 30 and each include a front bearing 74 (FIG. 4) that slidably or rollingly engages the track channel 26. Each of the rear drive links 60 include a rear bearing 76 that slidably or rollingly engages the track channel 26. Each rear drive link 60 also includes a peg 78 that slidably engages a slot 80 in the corresponding side plate 54. Coupling links 83 (FIG. 2) connect the rear drive links 60 to a drive rod 84 of the legrest mechanism 18 so that rotation of the drive rod 84 causes the rear drive links 60 to rotate relative to the side plates 54.

The legrest mechanism 18 may include the drive rod 84 and a pair of pantograph linkages 86. A handle 88 is connected to an end of the drive rod 84. Rotation of the handle 88 relative to the base frame 30 causes corresponding rotation of the drive rod 84 relative to the base frame 30. Such rotation of the drive rod 84 causes the pantograph linkages 86 to move between the retracted position and the extended position. While not shown in the figures, a legrest platform is attached to and supported by the pantograph linkages 86 such that a user may rest his or her legs and/or feet on the legrest platform while sitting in the furniture member 10 while the legrest mechanism 18 is in the extended position.

With continued reference to FIGS. 1-17, operation of the furniture member 10 will be described in detail. As described above, the frame assembly 14 and the tilt mechanism 16 are movable relative to the base assembly 12 among an upright position (FIGS. 1-6), a pre-tilt position (FIGS. 7-11) and a fully reclined position (FIGS. 12-16). The legrest mechanism 18 is movable relative to the base assembly 12 and the frame assembly 14 between a retracted position (FIGS. 1-6) and an extended position (FIGS. 7-16).

Figure 9:
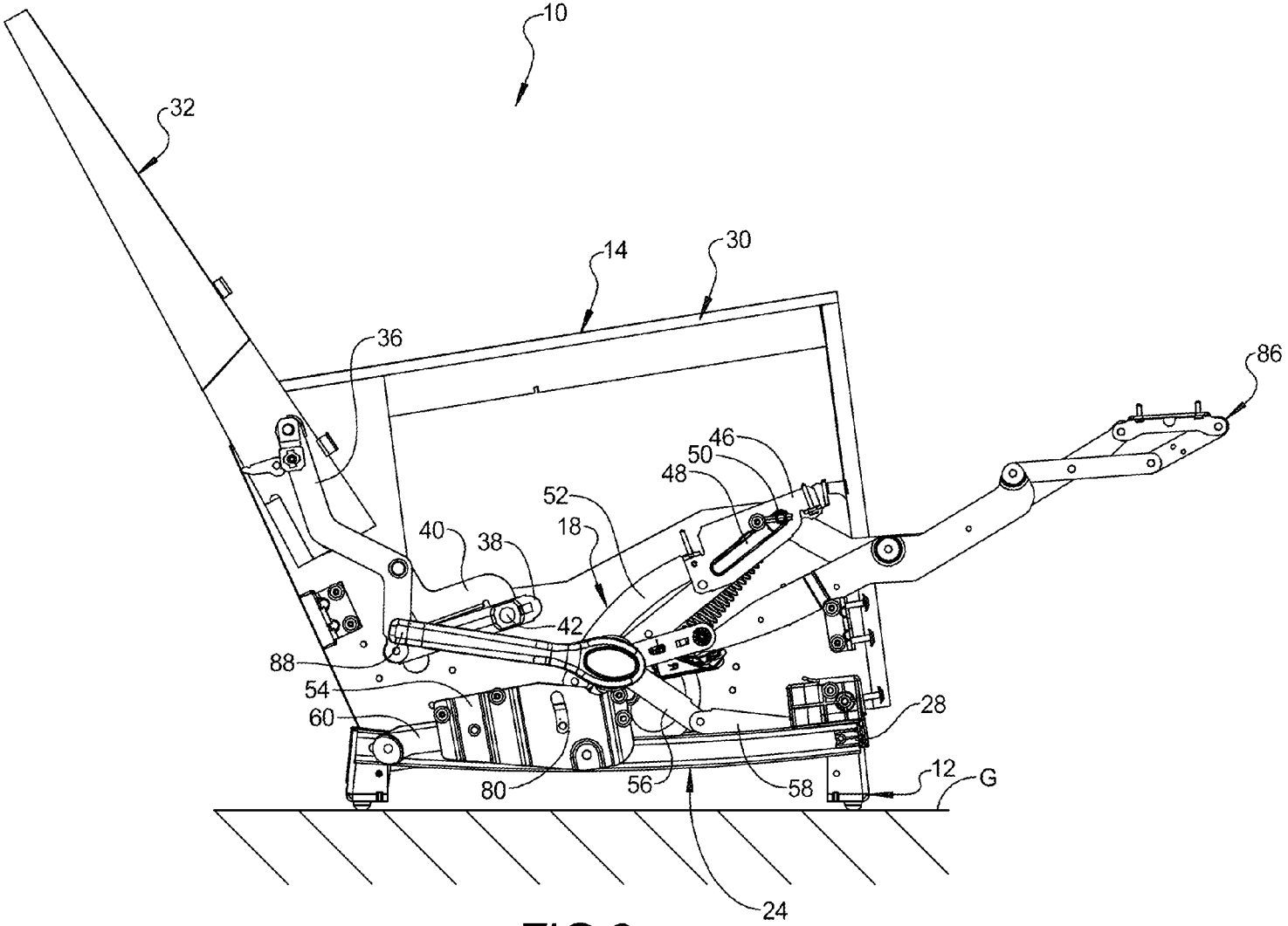
FIG. 9 is a side view of the furniture member in the pre-tilt position with portions of the frame removed for clarity.
Figure 10:
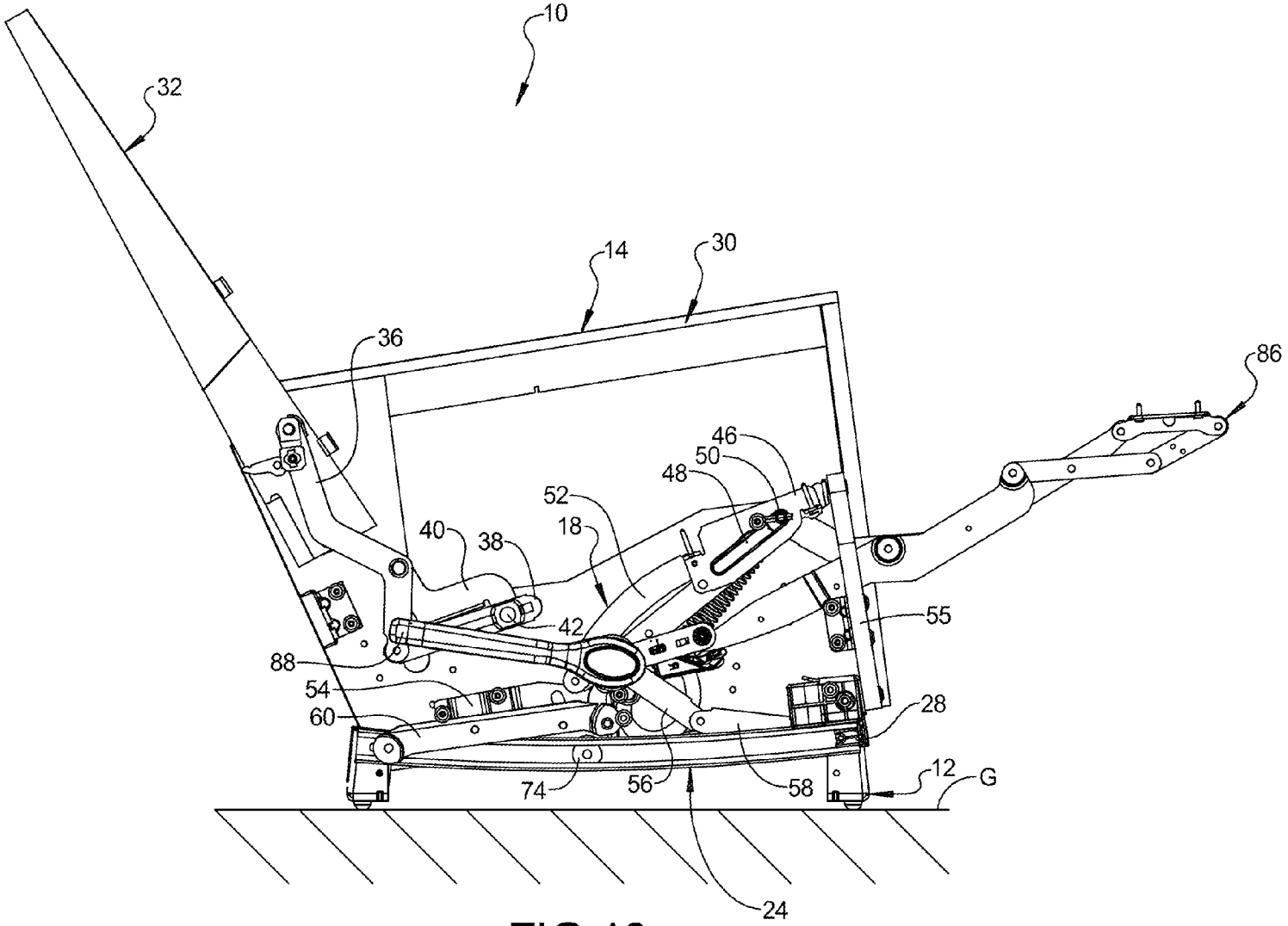
FIG. 10 is another side view of the furniture member in the pre-tilt position with portions of the frame and tilt mechanism removed for clarity.
Figure 11:
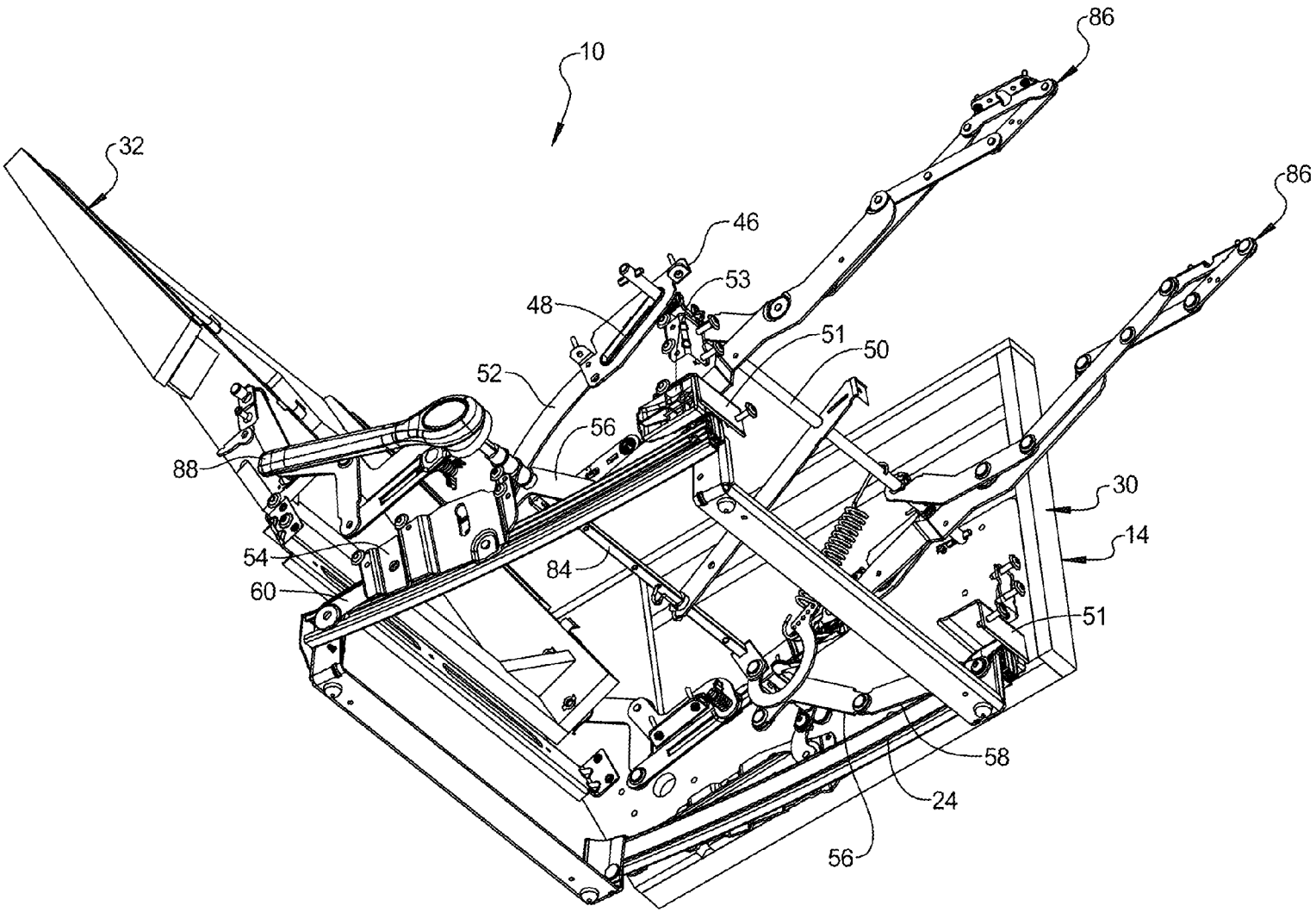
FIG. 11 is another perspective view of the furniture member in the pre-tilt position with portions of the frame removed for clarity.
Figure 12:
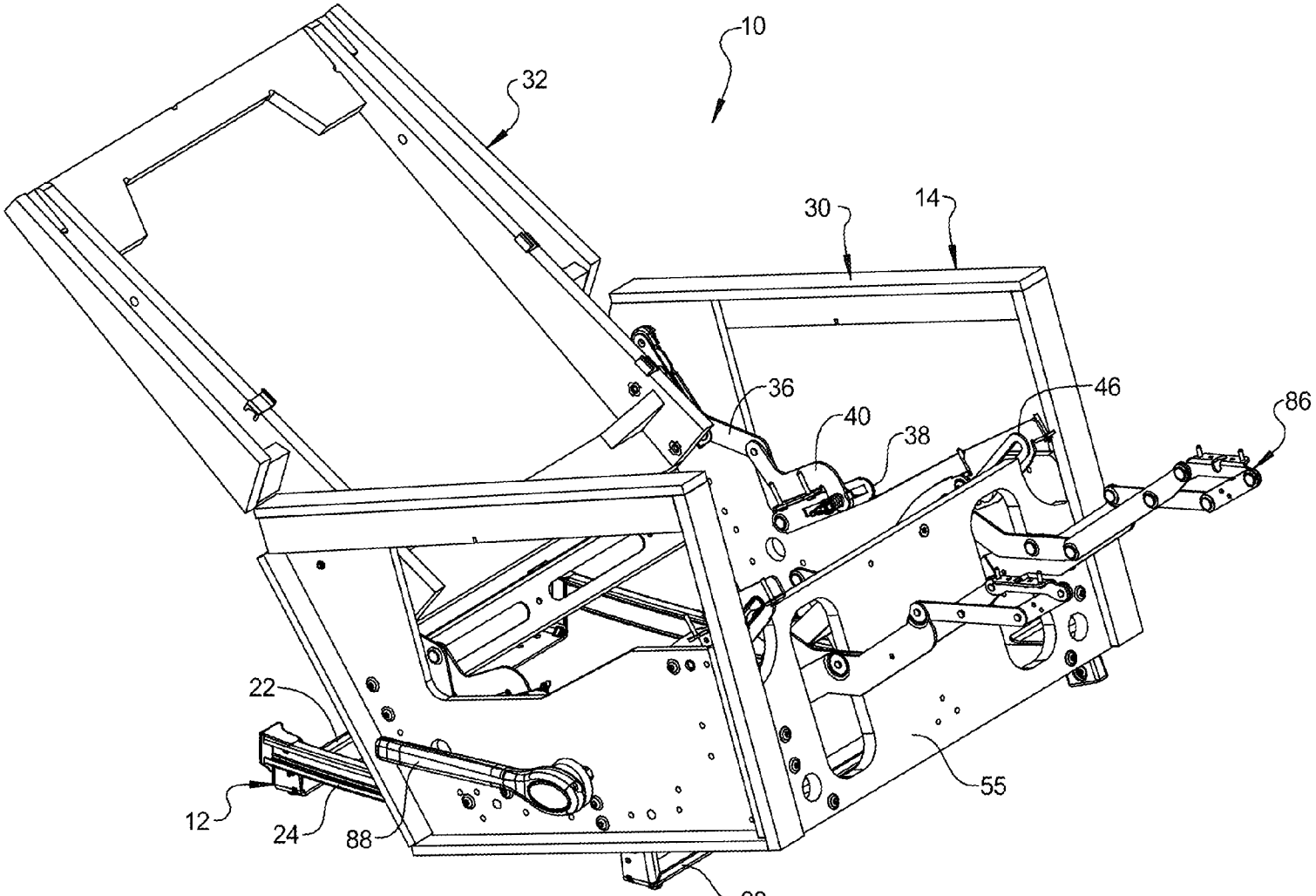
FIG. 12 is a perspective view of the furniture member in a fully reclined position according to the principles of the present disclosure.
Figure 13:
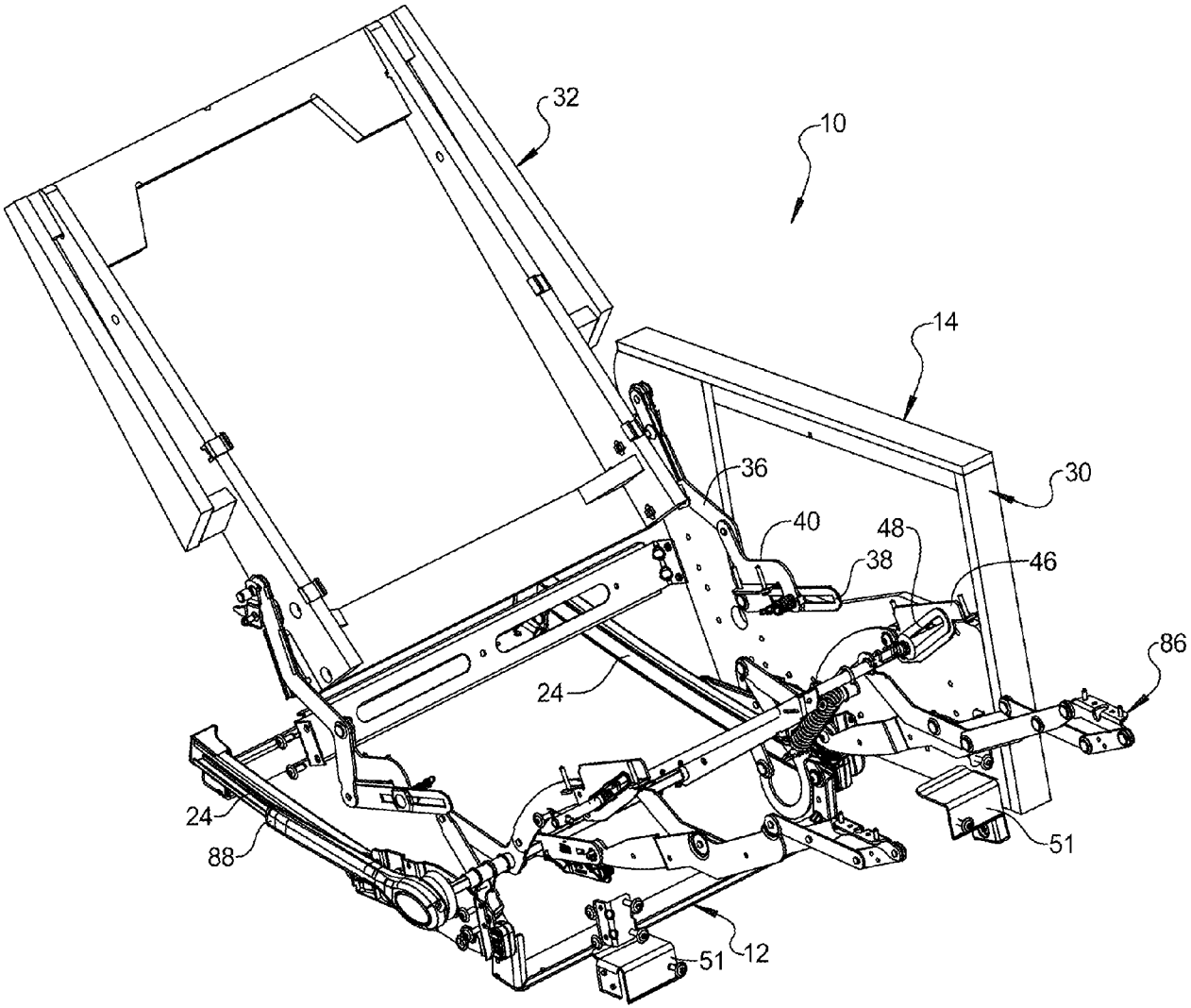
FIG. 13 is another perspective view of the furniture member in the fully reclined position with portions of the frame removed for clarity.
Figure 14:
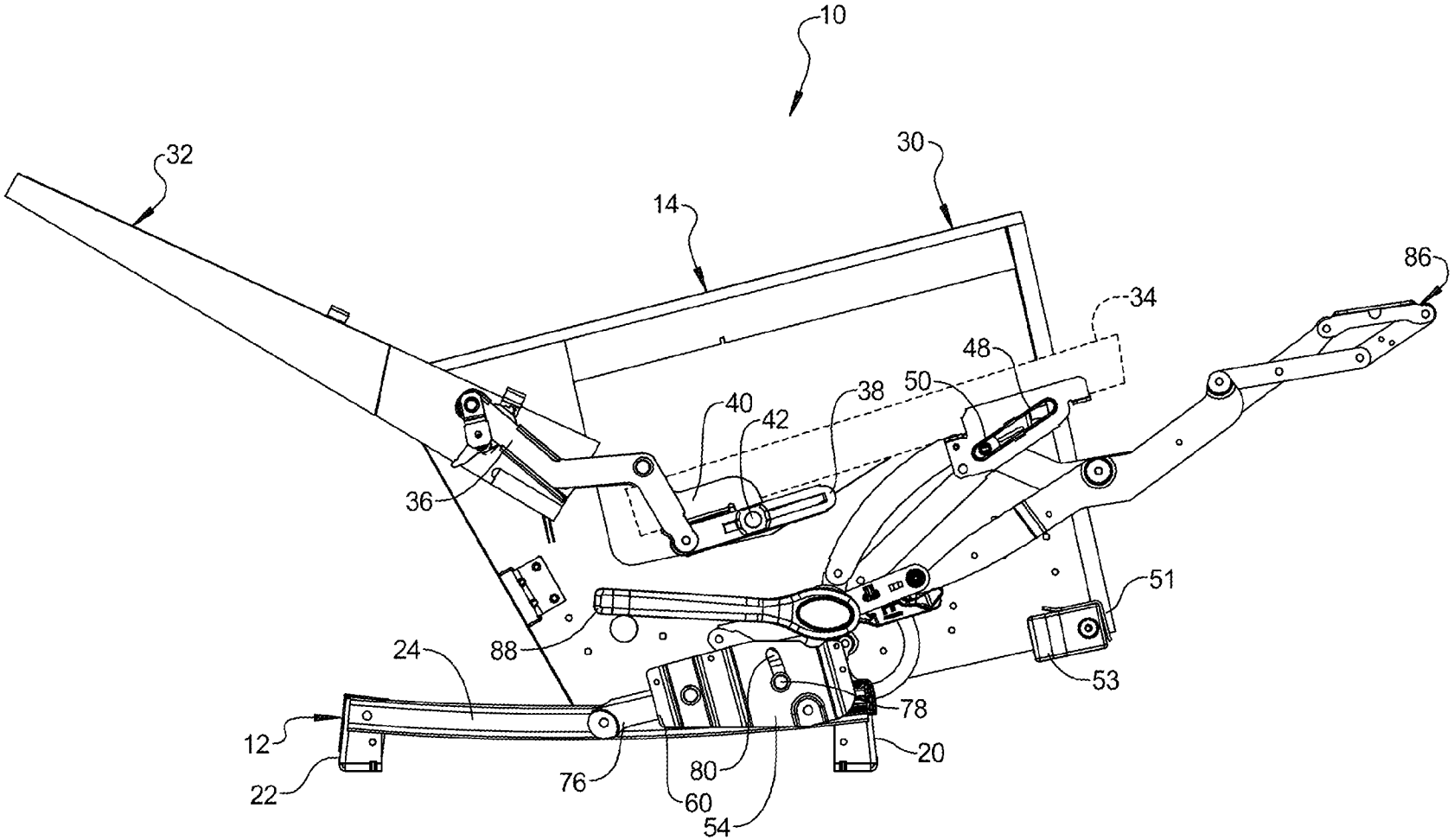
FIG. 14 is a side view of the furniture member in the fully reclined position with portions of the frame removed for clarity.

As shown in FIG. 3, when the furniture member 10 is in the upright position, the base frame 30, the seatback frame 32 and the seat bottom frame 34 are oriented in a first position relative to the support surface G. As shown in FIG. 9, when the furniture member 10 is in the pre-tilt position, the base frame 30, the seatback frame 32 and the seat bottom frame 34 are oriented in a second position relative to the support surface G, however, the orientation of the base frame 30, the seatback frame 32 and the seat bottom frame 34 relative to each other may be the same in the upright and pre-tilt positions. The frame assembly 14 is tilted when the furniture member 10 is moved from the upright position to the pre-tilt position such that in the pre-tilt position, an aft end of the frame assembly 14 is vertically closer to the support surface G than it is in the upright position, and a front end of the frame assembly 14 is vertically farther apart from the support surface G than it is in the upright position. As shown in FIG. 14, moving the furniture member 10 to the fully reclined position causes further tilting of the frame assembly 14 relative to the support surface G and simultaneously causes relative movement between the base frame 30, seatback frame 32 and seat bottom frame 34. In the fully reclined position, an aft end of the base frame 30 is vertically closer to the support surface G than it is in the upright and pre-tilt positions, and a front end of the base frame 30 is vertically farther apart from the support surface G than it is in the upright and pre-tilt positions. Furthermore, the frame assembly 14 is translated forward (toward the front end of the rails 24) as the furniture member 10 is moved into the fully reclined position so that the furniture member 10 can maintain a desired amount of clearance from a wall (not shown) in a room in which the furniture member 10 is situated in the upright and fully reclined positions without moving the base assembly 12 relative to the wall.

In the upright position, the front and rear bearings 74, 76 of the tilt mechanism 16 are disposed in a first position along the track channels 26 of the rails 24. As shown in FIG. 4, the front bearings 74 are spaced apart from the stop plugs 28 in the upright position. Furthermore, FIG. 4 depicts the base stop members 51 (which are fixedly attached to the base frame 30) contacting the stop plugs 28 such that each base stop member 51 contacts a corresponding stop plug 28 at two locations when the furniture member 10 is in the upright position. More specifically, the first and second legs 57, 59 of each base stop member 51 are both in contact with different portions of the flange portion 31 of the stop plug 28. Such contact between the base stop members 51 and the flange portions 31 of the stop plugs 28 improves the stability of the furniture member 10 while the furniture member 10 is in the upright position, particularly while the user of the furniture member 10 is entering or exiting the furniture member 10 (i.e., lowering his or her body into the furniture member or standing up out of the furniture member 10).

Figure 5:
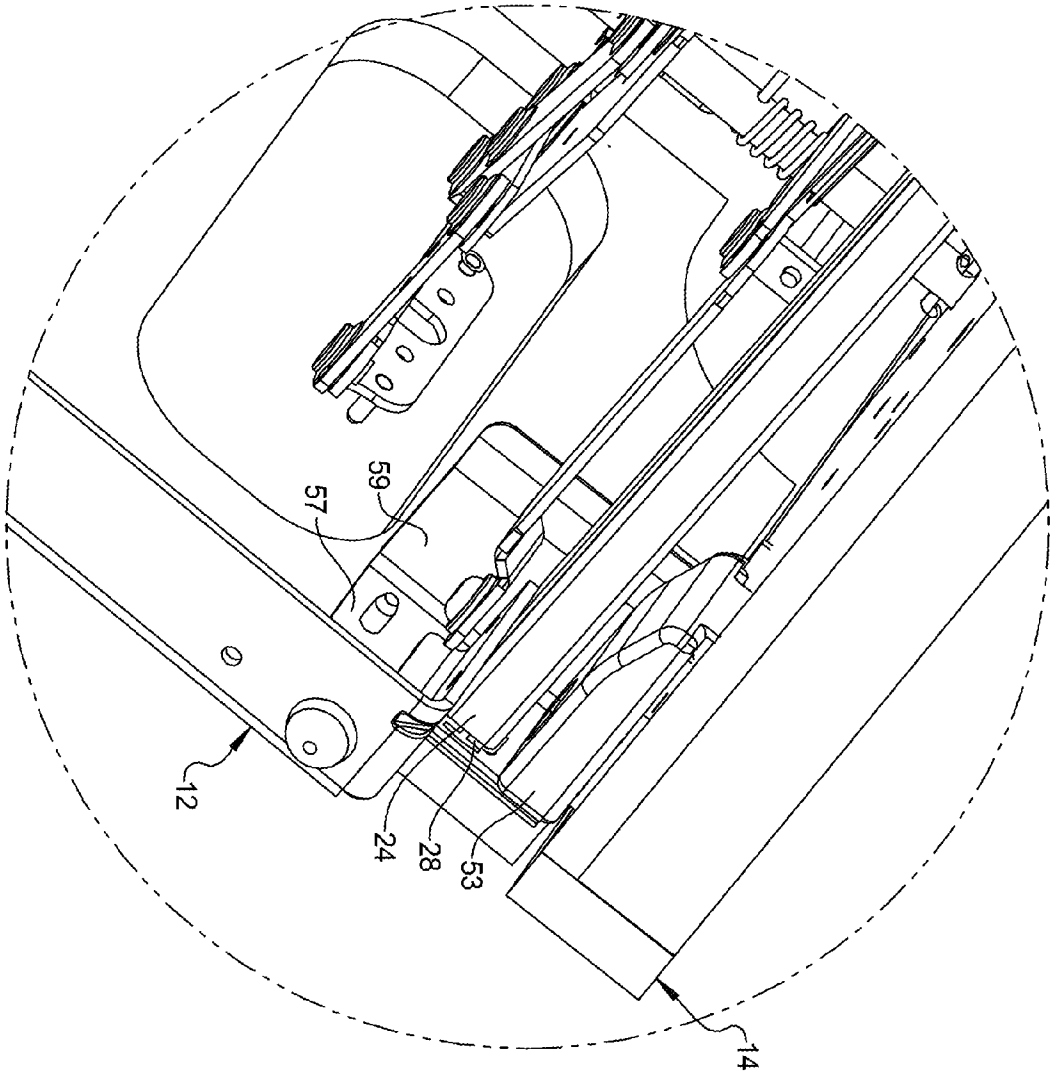
FIG. 5 is another perspective view of a portion of the furniture member in the upright position.
Figure 6:
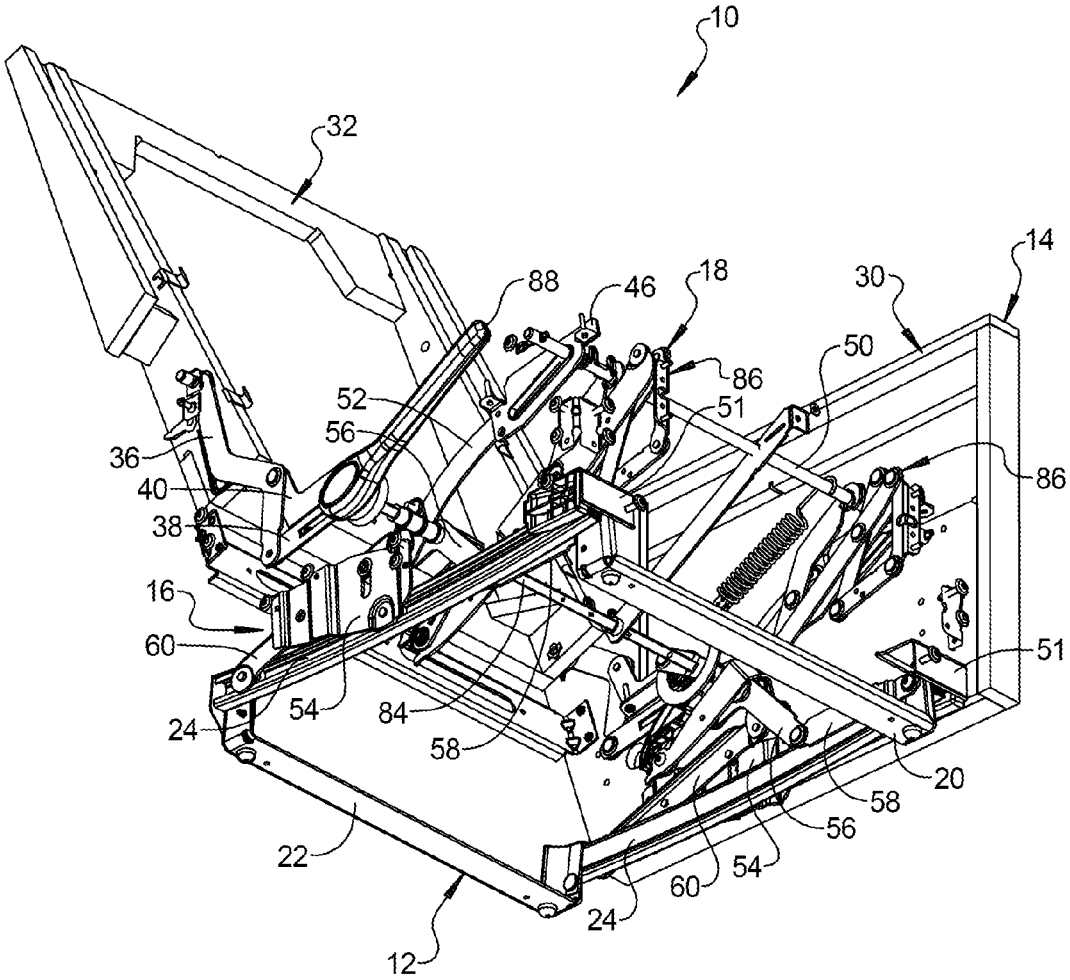
FIG. 6 is another perspective view of the furniture member in the upright position with portions of the frame removed for clarity.
Figure 7:
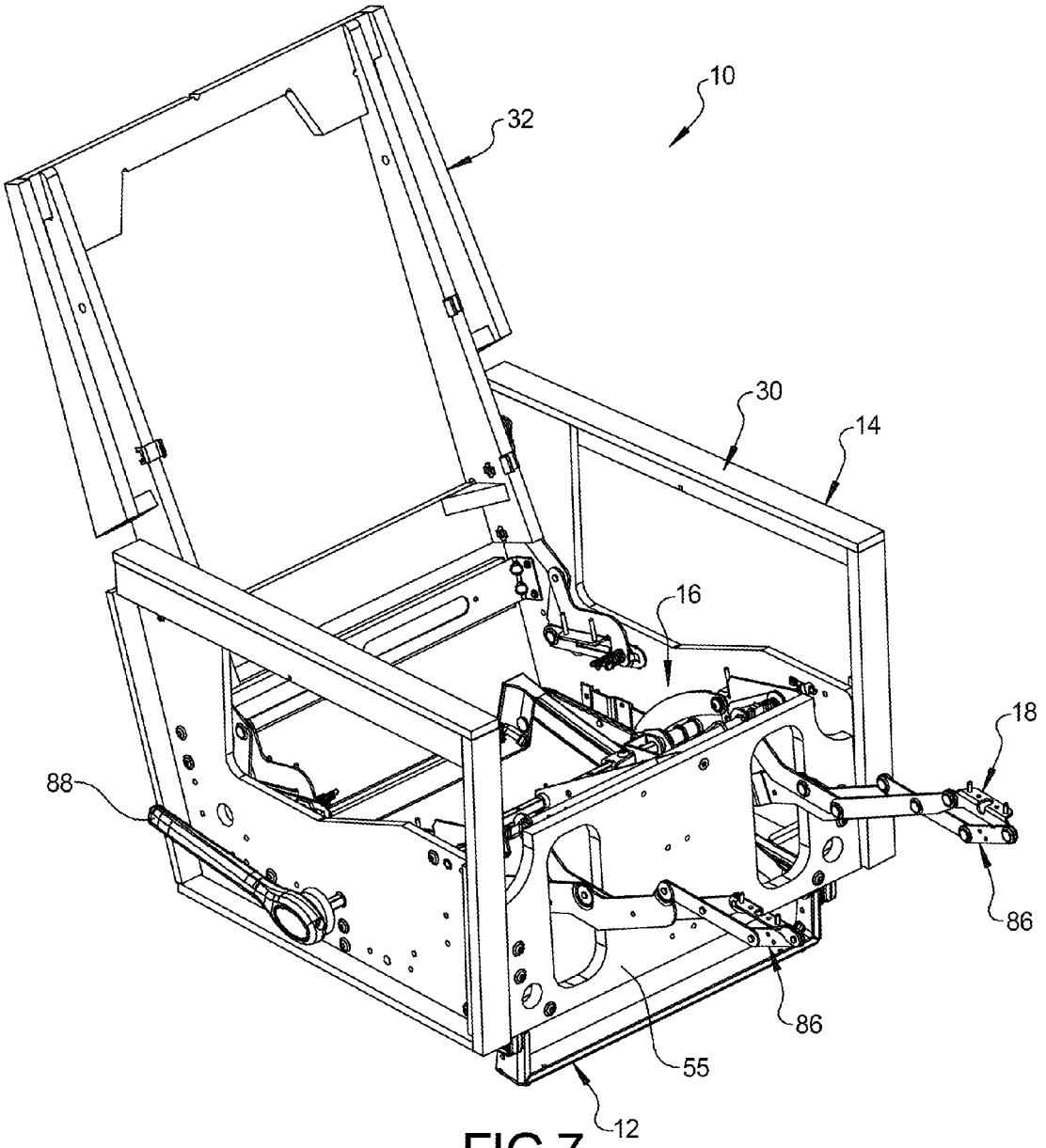
FIG. 7 is a perspective view of the furniture member in a pre-tilt position according to the principles of the present disclosure.
Figure 8:
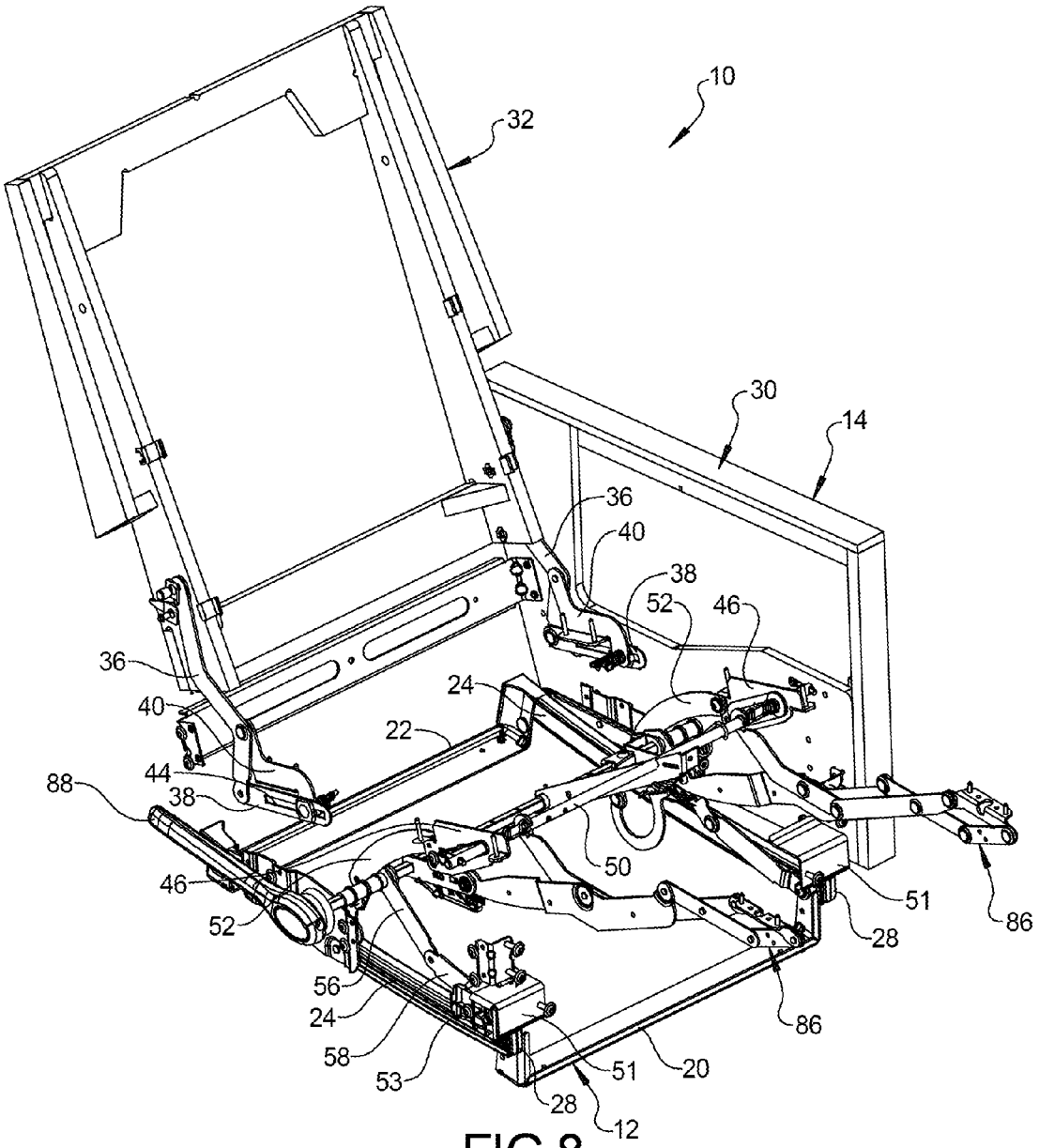
FIG. 8 is another perspective view of the furniture member in the pre-tilt position with portions of the frame removed for clarity.

Furthermore, the proximity of the side stop members 53 relative to the rails 24 (when the furniture member 10 is in the upright position) limits an amount of lateral movement (side-to-side movement) of the frame assembly 14 relative to the base assembly 12. As shown in FIG. 5, only a small gap exists between each rail 24 and adjacent side stop member 53 when the furniture member 10 is in the upright position. In some embodiments, both of the side stop members 53 may simultaneously contact their respective rails 24. Limiting the range of relative lateral movement between the frame assembly 14 and the base assembly 12 improves the stability of the furniture member 10 while the furniture member 10 is in the upright position, particularly while the user of the furniture member 10 is entering or exiting the furniture member 10. The base stop members 51 and the side stop members 53 may be spaced apart from the stop plugs 28 and rails 24 in the pre-tilt and fully reclined positions.

To move the furniture member 10 from the upright position to the pre-tilt position, the user may rotate the handle 88 from the position shown in FIG. 3 to the position shown in FIG. 9. Such rotation of the handle 88 causes corresponding movement of the drive rod 84, which causes rotation of the coupling links 83, which in turn, pivots the rear drive links 60 relative to the side plates 54 such that the pegs 78 connected to the rear drive links 60 slide downward in the slots 80 in the side plates 54. Rotation of the coupling links 83 also causes the rear drive links 60 and the side plates 54 to translate rearward relative to the rails 24 (i.e., the front and rear bearings 74, 76 move within the track channels 26 toward the rear end of the track channels 26). Rotation of the drive rod 84 caused by rotation of the handle 88 from the position shown in FIG. 3 to the position shown in FIG. 9 also causes the upper front drive links 56 to rotate, which in turn, causes the lower front drive links 58 and the upper connecting links 52 to rotate. This synchronized movement of the tilt mechanism 16 in response to movement of the handle 88 from the position shown in FIG. 3 to the position shown in FIG. 9 causes the frame assembly 14 to tilt backward relative to the support surface G. Furthermore, as described above, such rotation of the handle 88 and drive rod 84 also simultaneously causes the pantograph linkages 86 to move into the extended position.

Figure 15:
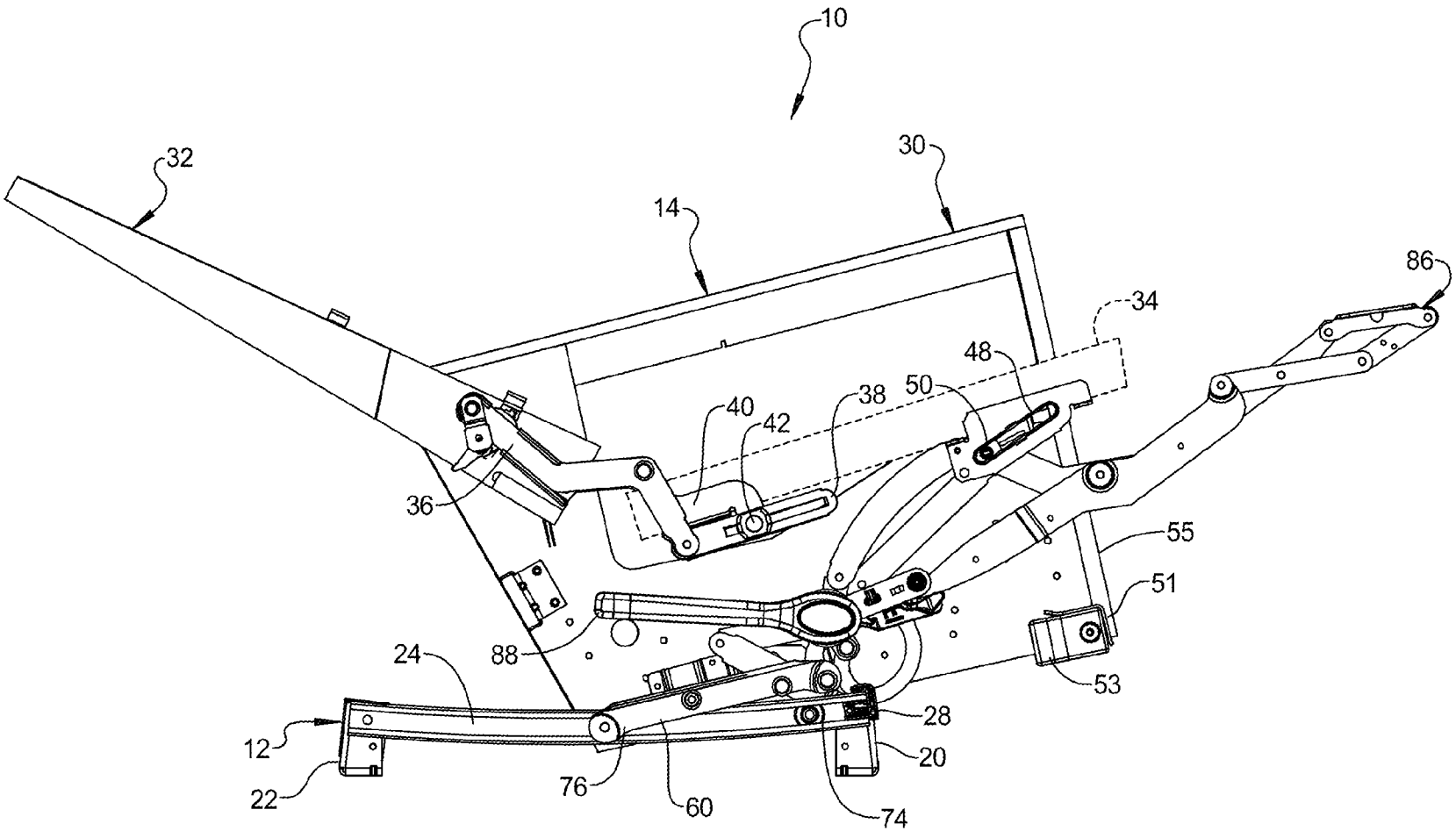
FIG. 15 is another side view of the furniture member in the fully reclined position with portions of the frame and tilt mechanism removed for clarity.
Figure 16:
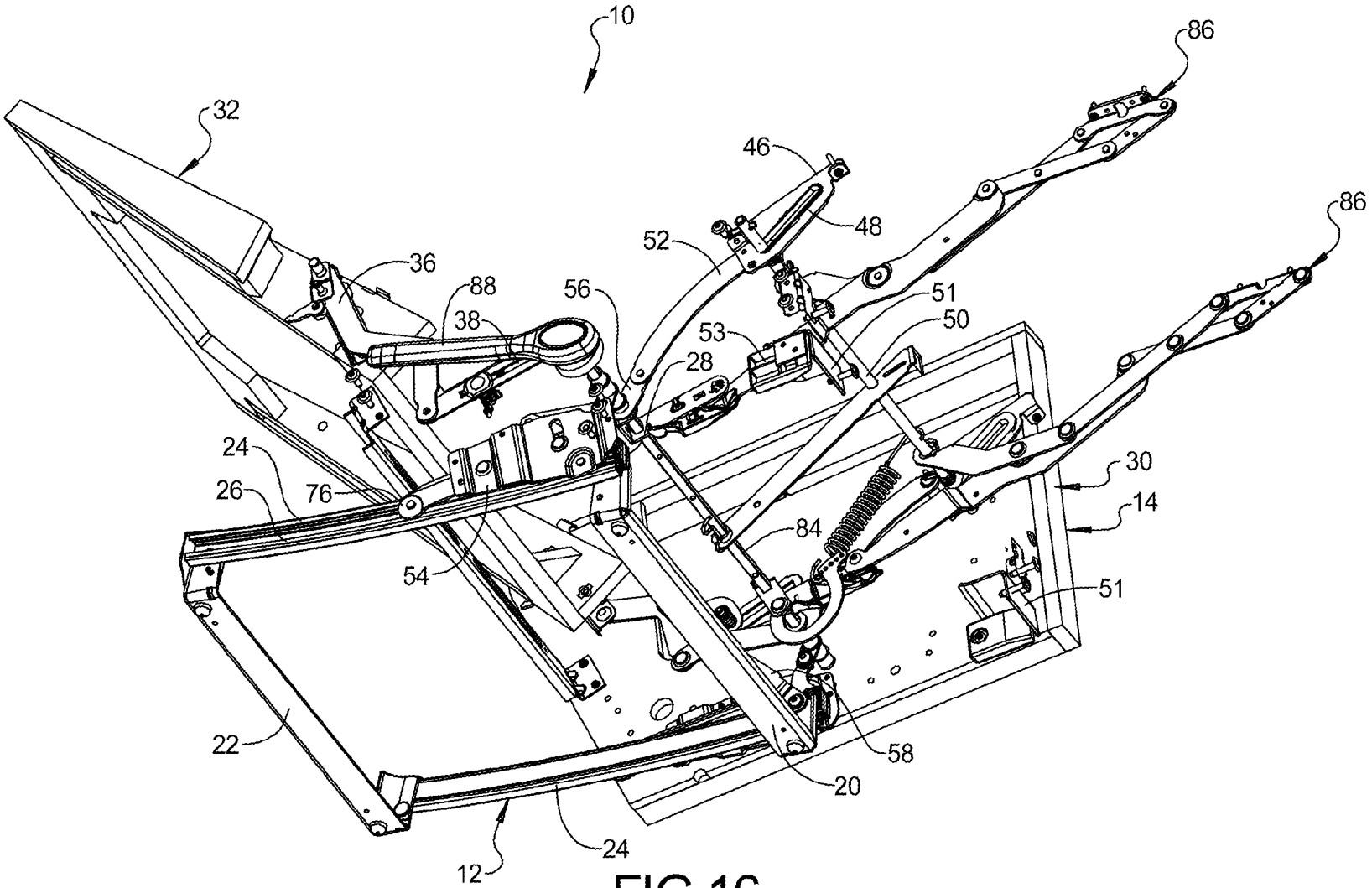
FIG. 16 is another perspective view of the furniture member in the fully reclined position with portions of the frame removed for clarity.
Figure 17:
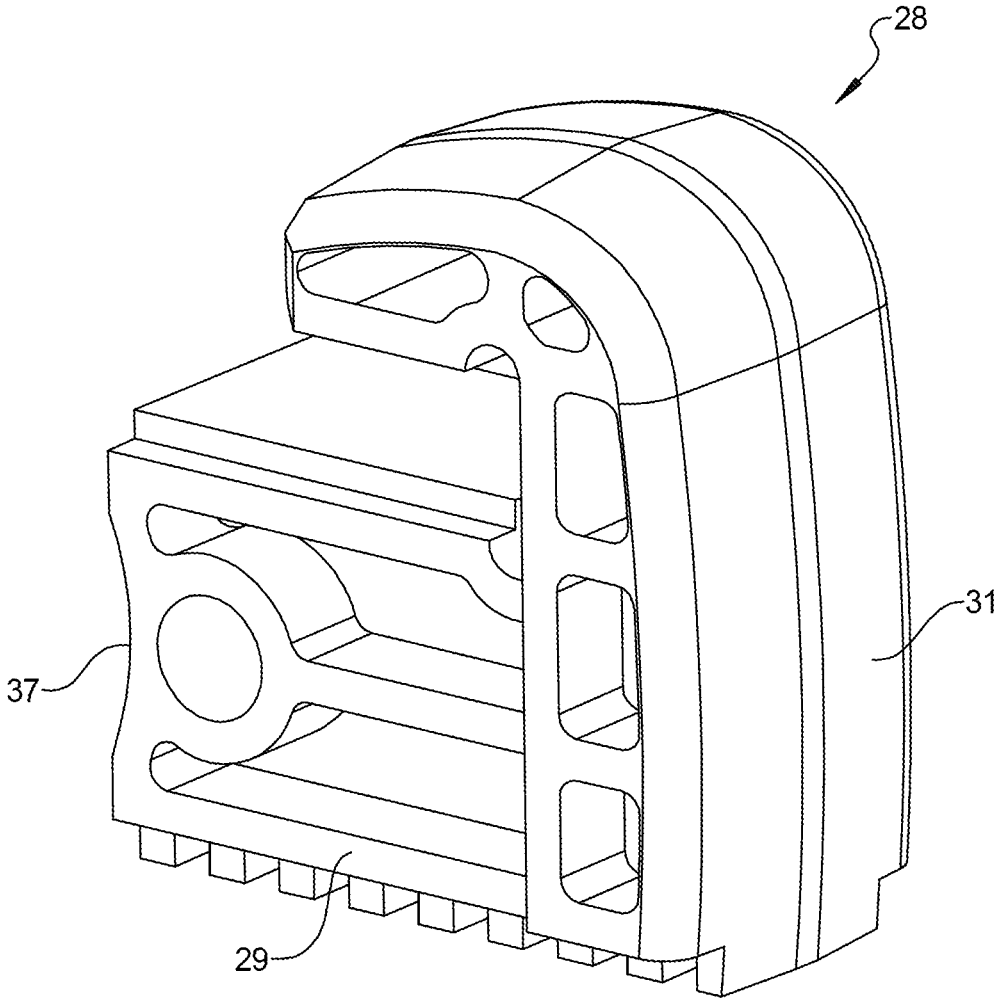
FIG. 17 is a perspective view of a stop plug according to the principles of the present disclosure.
Figure 18:
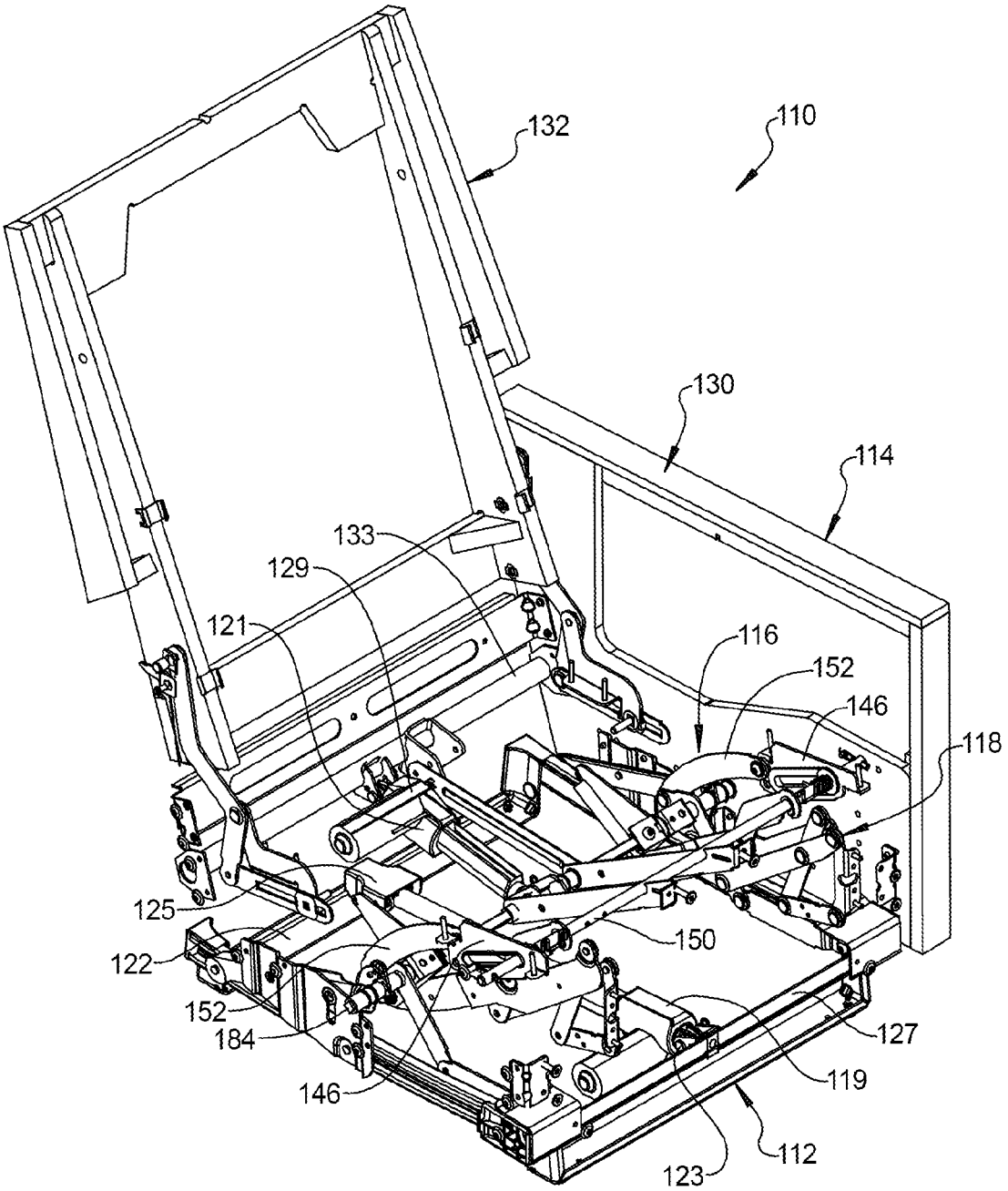
FIG. 18 is a partial perspective view of another furniture member in an upright position according to the principles of the present disclosure.

To move the furniture member 10 from the upright position to the fully reclined position or from the pre-tilt position to the fully reclined position, the user may lean back against the seatback frame 32 to cause the seatback frame 32 to rotate relative to the base frame 30. Such movement of the seatback frame 32 causes the seat bottom frame 34 and the front arms 46 to move forward relative to the base frame 30. Such movement of the front arms 46 relative to the base frame 30 causes forward movement of the upper connecting links 52, which in turn, causes rotation of the upper and lower front drive links 56, 58. Because the second ends 72 of the lower front drive links 56 are attached to the frame assembly 12 (i.e., to the rails 24 and/or to the front support member 20), such rotation of the upper and lower front drive links 56, 58 guides the tilt mechanism 16 and the frame assembly 14 forward along the rails 24 until the front bearings 74 contact the body portions 29 of the stop plugs 28 (FIG. 15). Such movement of the tilt mechanism 16 causes the frame assembly 14 to be simultaneously translated forward relative to the base assembly 12 and tilted rearward relative to the base assembly 12.

Figure 19:
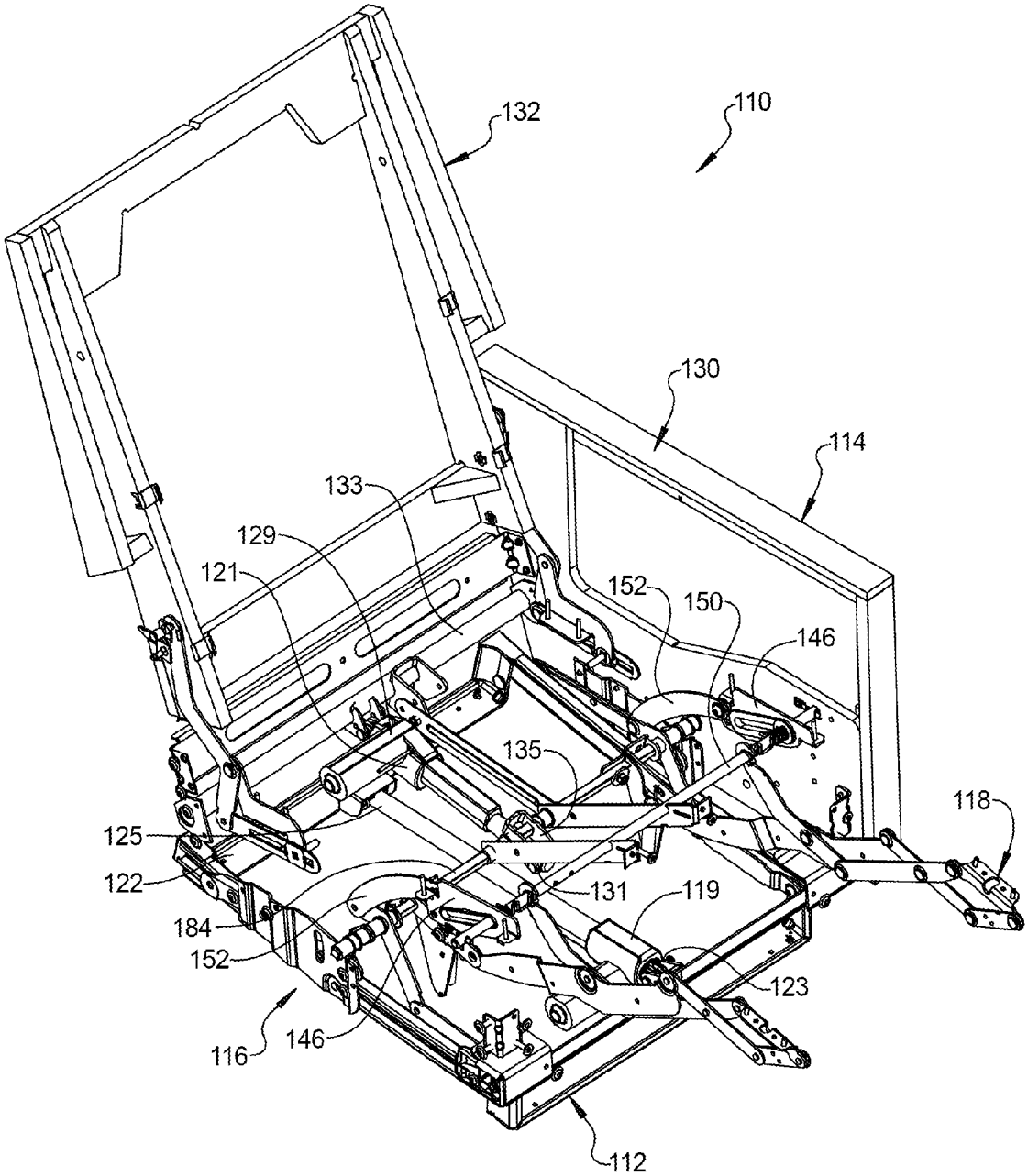
FIG. 19 is a partial perspective view of the furniture member of FIG. 18 in a pre-tilt position.
Figure 20:
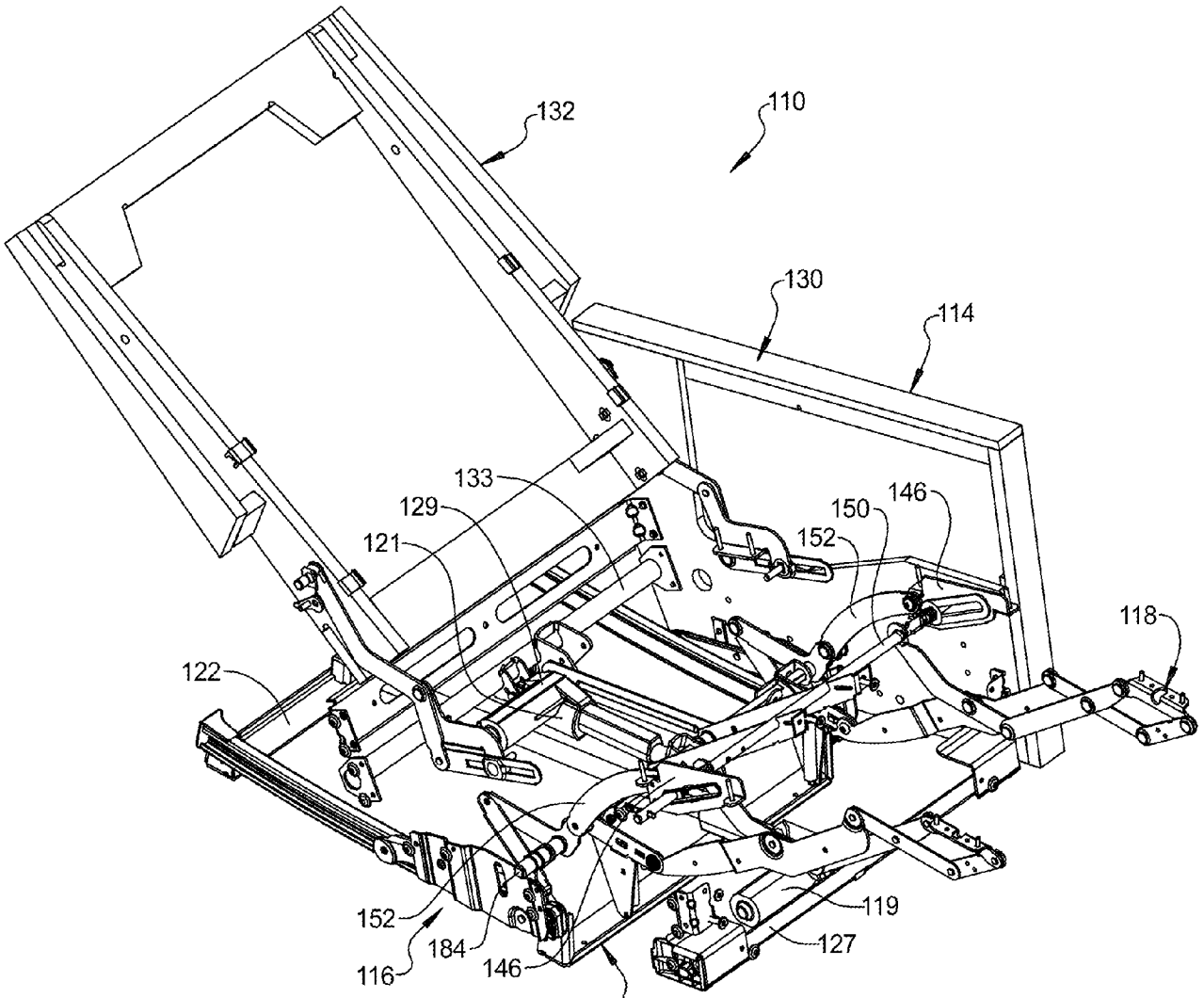
FIG. 20 is a partial perspective view of the furniture member of FIG. 18 in a fully reclined position.

Referring now to FIGS. 18-21, another furniture member 110 is provided that may include a base assembly 112, a frame assembly 114, a tilt mechanism 116, a legrest mechanism 118, a first electromechanical linear actuator 119 and a second electromechanical linear actuator 121. The structure and function of the base assembly 112, frame assembly 114, tilt mechanism 116 and legrest mechanism 118 may be similar or identical to that of the base assembly 12, frame assembly 14, tilt mechanism 16 and legrest mechanism 18 described above, apart from any differences described herein and/or shown in the figures. Therefore, similar features will not be described again in detail. Like the furniture member 10, the frame assembly 114 and the tilt mechanism 116 of the furniture member 110 are movable relative to the base assembly 112 among an upright position (FIG. 18), a pre-tilt position (FIG. 19) and a fully reclined position (FIG. 20). The legrest mechanism 118 is movable relative to the base assembly 112 and the frame assembly 114 between a retracted position (FIG. 18) and an extended position (FIGS. 19 and 20).

The first linear actuator 119 may have a first end 123 fixed relative to the frame assembly 114 and a second end 125 fixed relative to the base assembly 112. More specifically, the first end 123 may be fixedly attached to a cross member 127 mounted to a front portion of the frame assembly 114, and the second end 125 may be fixedly attached to a rear support member 122 of the base assembly 112. The first linear actuator 119 can telescopically increase and decrease its length to move the first end 123 closer to or farther away from the second end 125, which causes corresponding movement of the tilt mechanism 116 to translate and tilt the frame assembly 114 relative to the base assembly 112 between the upright and fully reclined positions in the manner described above. That is, movement of the first end 123 away from the second end 125 causes the frame assembly 114 to tilt rearward and translate forward relative to the base assembly 112, thereby moving the furniture member 110 toward the fully reclined position. Movement of the first end 123 toward the second end 125 causes the frame assembly 114 to tilt forward and translate rearward relative to the base assembly 112, thereby moving the furniture member 110 toward the upright position.

Like the tilt mechanism 16, the tilt mechanism 116 may include a upper connecting links 152 that are connected to front arms 146 that support a seat bottom frame (like seat bottom frame 34) of the frame assembly 114. Accordingly, operation of the first linear actuator 119 to move the first end 123 away from the second end 125 causes corresponding movement of the front arm 146 relative to support rod 150 (which is attached to base frame 130 of the frame assembly 114), thereby causing the seat bottom frame to translate forward relative to the base frame 130. In the manner described above with respect to the furniture member 10, translation of the seat bottom frame forward relative to the base frame 130 causes rotation of the seatback frame 132 relative to the base frame 130.

The second linear actuator 121 may have a first end 129 fixed relative to the frame assembly 114 and a second end 131 (FIG. 19) operatively coupled to the legrest mechanism 118. More specifically, the first end 129 may be fixedly attached to a cross member 133 mounted to a rear portion of the frame assembly 114, and the second end 131 may be rotatably coupled to a crank link 135 (FIG. 19) that is rotatably coupled to a drive rod 184 of the legrest mechanism 118. The second linear actuator 121 can telescopically increase and decrease its length to move the second end 131 closer to or farther away from the first end 129, which causes corresponding rotation of the drive rod 184. As described above with respect to the furniture member 10, rotation of the drive rod 184 can move the legrest mechanism 118 between the retracted and extended positions and can move the frame assembly 114 relative to base assembly 112 between the upright and pre-tilt positions.

Figure 21:
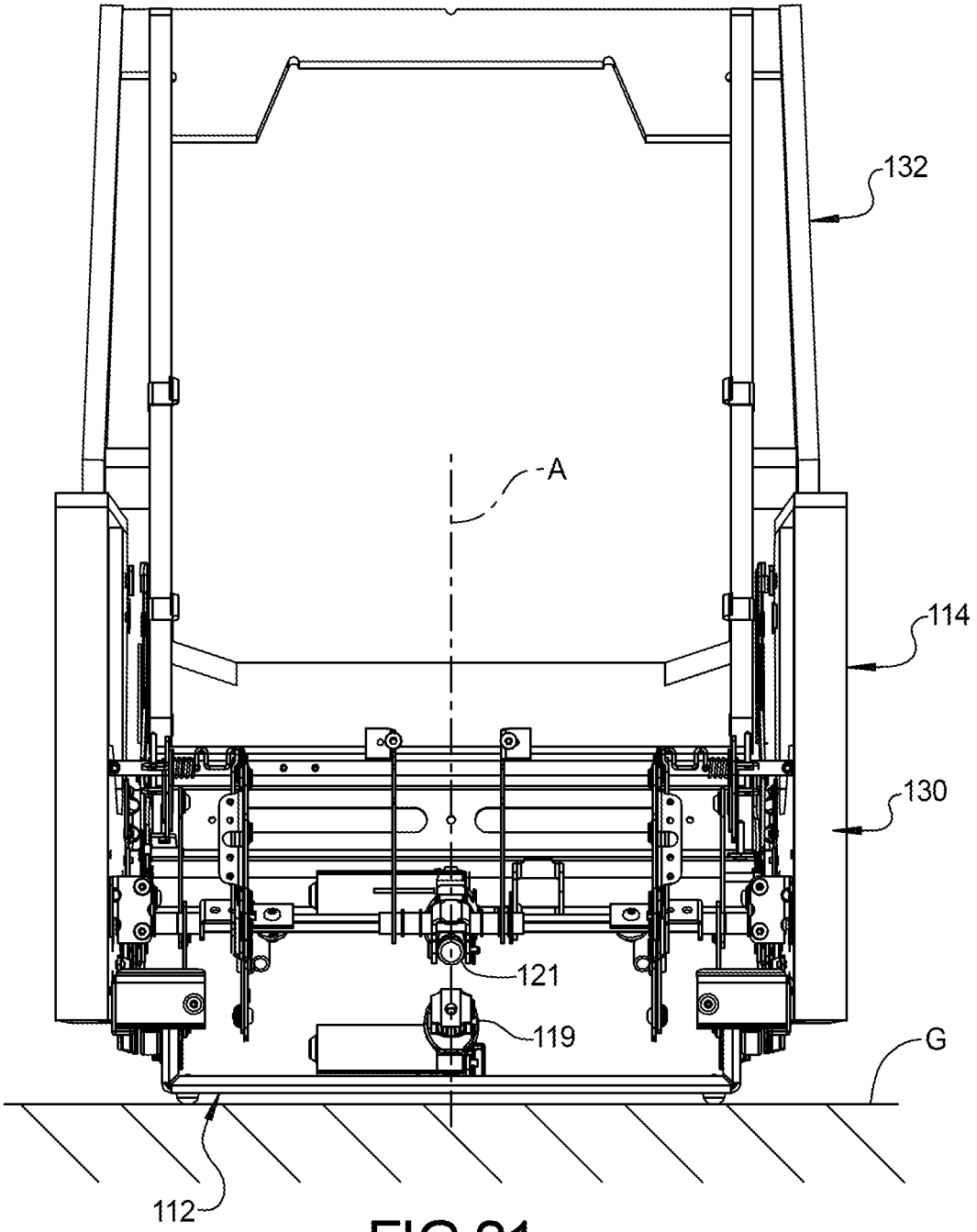
FIG. 21 is a front view of the furniture member of FIG. 18.

As shown in FIG. 21, the first and second linear actuators 119, 121 may be aligned with each other and with an axis A that is perpendicular to the support surface G and extends vertically upward from the support surface G. that is, the second linear actuator 121 is disposed vertically above the first linear actuator 119 along the axis A. This arrangement of the linear actuators 119, 121 improves stability of the furniture member 10 during operation of the linear actuators 119, 121, as reaction forces caused by operation of the linear actuators 119, 121 can at least partially counteract each other.

Figure 22:
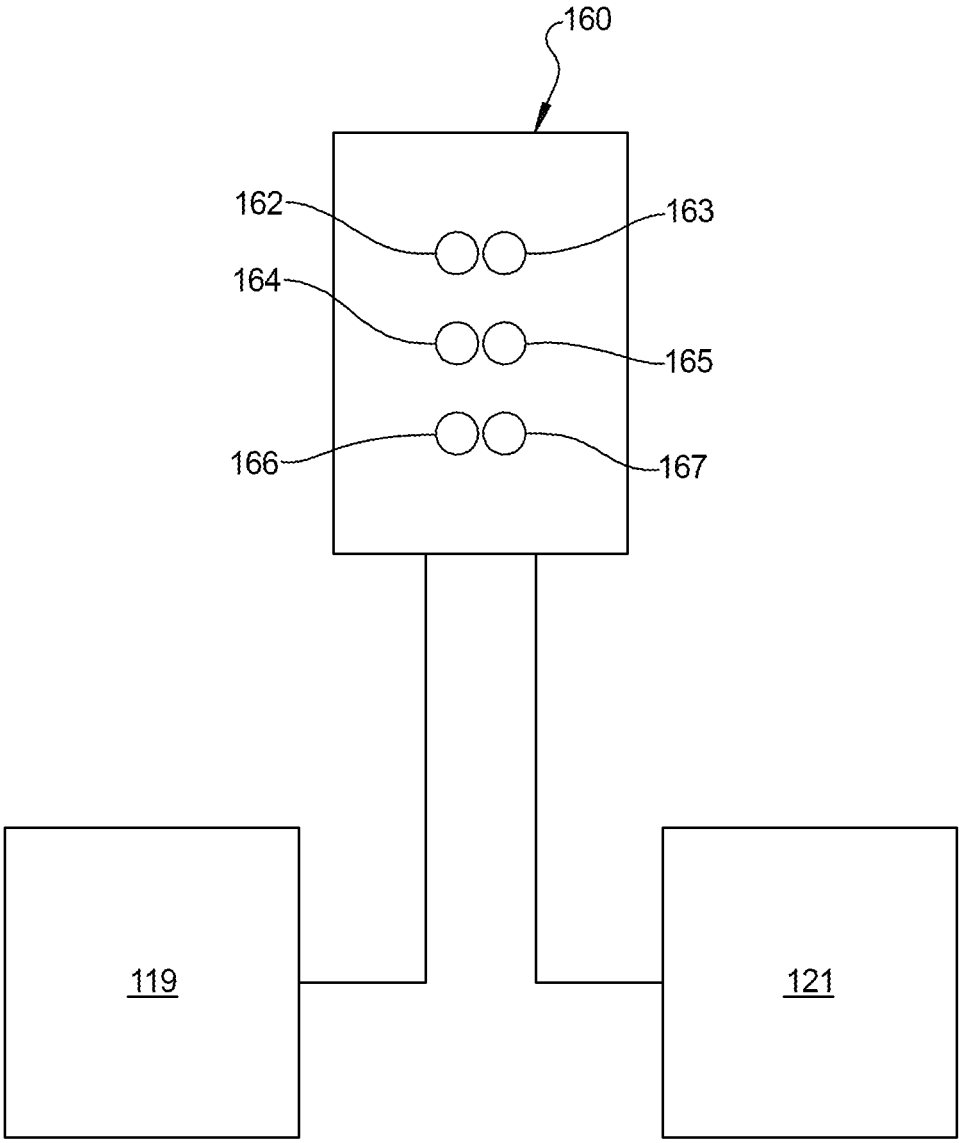
FIG. 22 is a schematic representation of a controller electrically connected to first and second actuators of the furniture member of FIG. 18.

The furniture member 110 may include a controller 160 (shown schematically in FIG. 22) in electrical communication with the first and second actuators 119, 121. The controller 160 may include circuitry configured to selectively actuate one or both of the first and second actuators 119, 121. Such circuitry may include first, second, third, fourth, fifth and sixth switches 162, 163, 164, 165, 166, 167. The switches 162, 163, 164, 165, 166, 167 can include buttons, toggle switches or other structure to allow the user of the furniture member 110 to control the switches 162, 163, 164, 165, 166, 167.

The first and second switches 162, 163 may control operation of the first actuator 119 independently of the operation of the second actuator 121 by allowing and preventing electrical current to reach the first actuator 119.

In this manner the first and second switches 162, 163 can be used to move the tilt mechanism 116 independently of the legrest mechanism 118. The first switch 162 may move the tilt mechanism 116 in a first direction (e.g., to move the seatback frame 132 toward the fully reclined position), and the second switch 163 may move the tilt mechanism 116 in a second direction opposite the first direction (e.g., to move the seatback frame 132 toward the upright position).

The third and fourth switches 164, 165 may control operation of the second actuator 121 independently of the operation of the first actuator 119 by allowing and preventing electrical current to reach the second actuator 121. In this manner the third and fourth switches 164, 165 can be used to move the legrest mechanism 118 independently of the tilt mechanism 116. The third switch 164 may move the legrest mechanism 118 in a first direction (e.g., toward the fully extended position), and the fourth switch 165 may move the legrest mechanism 118 in a second direction opposite the first direction (e.g., toward the retracted position).

The fifth and sixth switches 166, 167 may control operation of the first and second actuators 119, 121 simultaneously by simultaneously controlling the flow of electrical current to the first and second actuators 119, 121. For example, the fifth switch 166 can be used to simultaneously move the tilt mechanism 116 toward the fully reclined position and move the legrest mechanism 118 toward the fully extended position. The sixth switch 167 can be used to simultaneously move the tilt mechanism 116 toward the upright position and move the legrest mechanism 118 toward the retracted position.

In some configurations, the controller 160 may include only the first, second, third and fourth switches 162, 163, 164, 165, and not the fifth and sixth switches 166, 167. In some configurations, the controller could include only the fifth and sixth switches 166, 167, and not the first, second, third and fourth switches 162, 163, 164, 165.

While the furniture members 10, 110 shown in FIGS. 1-21 are chairs, it will be appreciated that, in some configurations, the furniture members 10, 110 could be sofas, loveseats, sectionals, or any other motion furniture products.

Figure 23:
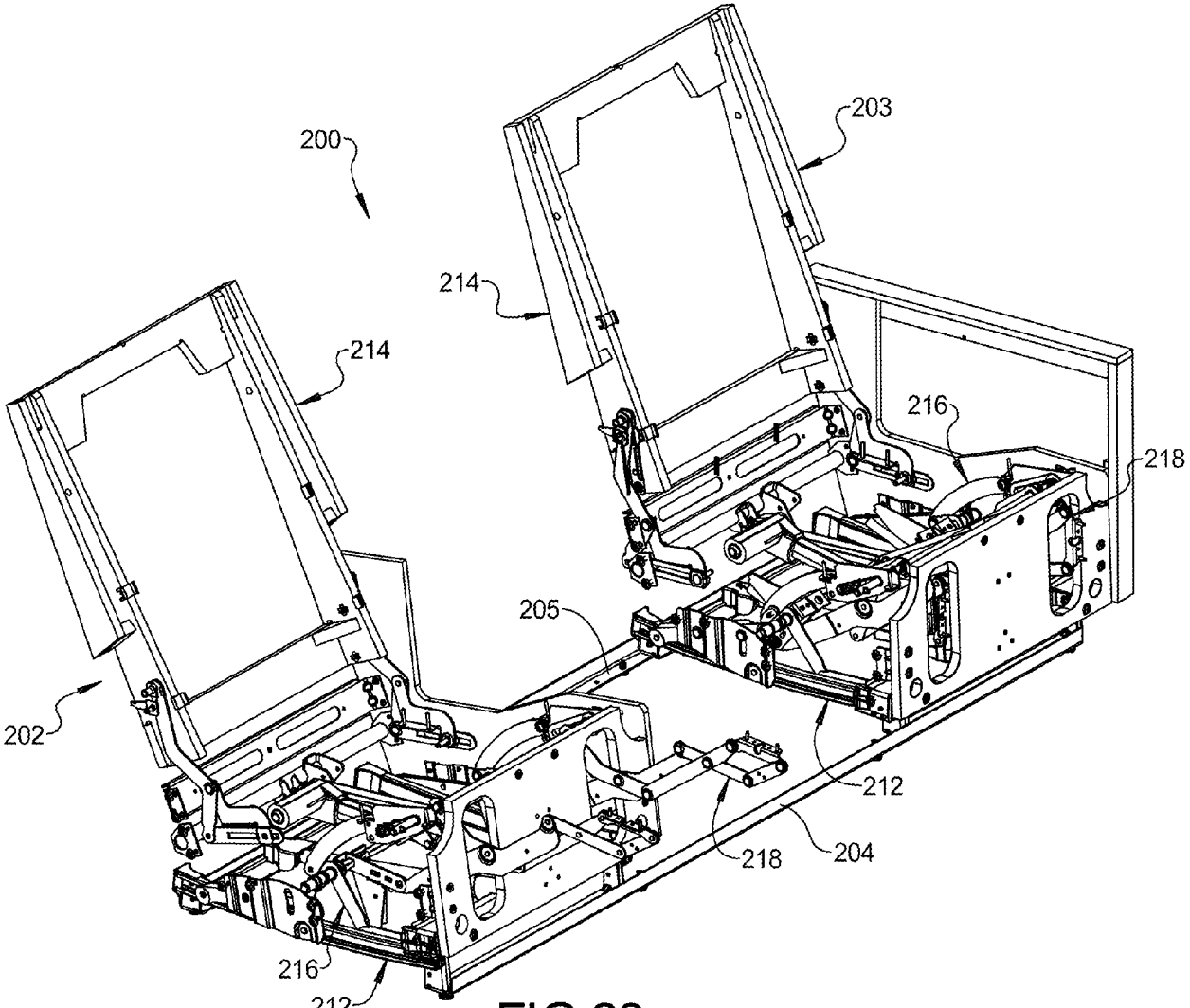
FIG. 23 is a partial perspective view of a motion sofa having one seat section in an upright position and another seat section in a pre-tilt position.
Figure 24:
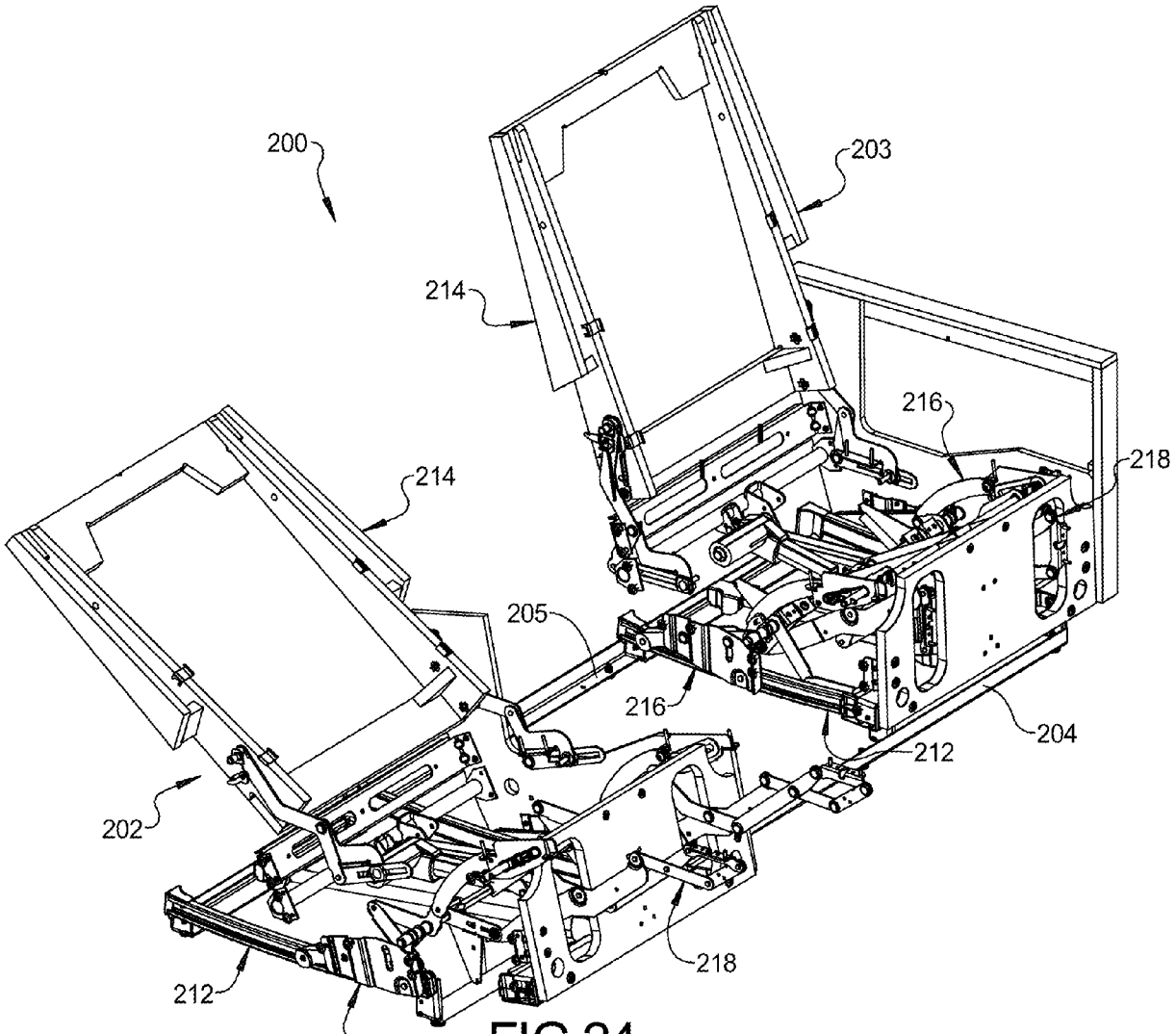
FIG. 24 is a partial perspective view of the motion sofa of FIG. 23 with one seat section in the upright position and another seat section in a fully reclined position.

Referring now to FIGS. 23 and 24, a motion sofa 200 is provided that may include first and second seat sections 202, 203 that are both mounted to first and second support rails 204, 205 and movable relative to each other and relative to the support rails 204, 205 between an upright position, a pre-tilt position, and a fully reclined position. FIG. 23 depicts the first seat section 202 in the pre-tilt position and the second seat section 203 in the upright position. FIG. 24 depicts the first seat section 202 in the fully reclined position and the second seat section 203 in the upright position. While not shown in FIGS. 23 and 24, the motion sofa 200 may include a third seat section mounted to the first and second support rails 204, 205 between the first and second seat sections 202. In some configurations, the third seat section may be fixed relative to the first and second support rails 204, 205. It will be appreciated that the motion sofa 200 could include any number of movable seat sections and any number of fixed seat sections.

Each of the first and second seat sections 202, 203 may include a base assembly 212, a frame assembly 214, a tilt mechanism 216, and a legrest mechanism 218. The structure and function of the base assembly 212, frame assembly 214, tilt mechanism 216 and legrest mechanism 218 can be similar or identical to that of the base assembly 12, 112, frame assembly 14, 114, tilt mechanism 16, 116 and legrest mechanism 18, 118 described above. Therefore, similar features will not be described again. The base assemblies 212 of seat sections 202, 203 are mounted to the first and second support rails 204, 205. The frame assembly 214, tilt mechanism 216 and legrest mechanism 218 of the first seat section 202 can be movable independently of the frame assembly 214, tilt mechanism 216 and legrest mechanism 218 of the second seat section 203.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a base assembly including a pair of rails extending parallel to each other between front and rear portions of the base assembly, each of the rails including a track and a stop plug at least partially received in a front end of the track;

a frame assembly including a base frame, a seatback frame and a seat bottom frame, the seatback frame being rotatably coupled to the base frame, the seat bottom frame being movably coupled to the seatback frame such that rotation of the seatback frame causes corresponding movement of the seat bottom frame relative to the seatback frame and the base frame; and a tilt mechanism supporting the base frame and coupled to the seat bottom frame, the tilt mechanism including drive links and side plates that slidably engage the tracks such that rotation of the seatback frame relative to the base frame causes the drive links and side plates to slide along the tracks, thereby translating the base frame relative to the base assembly, each of the side plates including a bearing that contacts one of the stop plugs when the seatback frame is in a fully reclined position, wherein a pair of base stop members are fixedly attached to the base frame, the base stop members are spaced apart from the stop plugs when the seatback frame is in the fully reclined position and abut the stop plugs when the seatback frame is in an upright position.

2. The furniture member of claim 1, wherein a side stop member is fixed relative to each of the base stop members, and wherein interference between side stop members and the tracks restricts relative lateral movement between the base frame and the base assembly.

3. The furniture member of claim 2, wherein each base stop member includes first and second legs forming an L-shaped profile, and wherein both of the first and second legs contacts the corresponding stop plug.

4. The furniture member of claim 1, wherein the base frame tilts relative to the base assembly as the base frame translates relative to the base assembly.

5. The furniture member of claim 1, further comprising a legrest mechanism that is movable between extended and retracted positions independently of movement of the seatback frame relative to the base frame.

6. The furniture member of claim 5, further comprising a first linear actuator and a second linear actuator, the first linear actuator powering movement of the tilt mechanism, the second linear actuator powering movement of the legrest mechanism.

7. The furniture member of claim 6, wherein the first linear actuator powers rotation of the seatback frame relative to the base frame.

8. The furniture member of claim 7, wherein the first linear actuator powers movement of the seat bottom frame relative to the base frame.

9. The furniture member of claim 8, wherein the first and second linear actuators are aligned with each other and with an axis that extends vertically upward from a support surface upon which the furniture member is situated for normal use, the axis being perpendicular to the support surface.

10. The furniture member of claim 9, wherein each base stop member includes first and second legs forming an L-shaped profile, and wherein both of the first and second legs contacts the corresponding stop plug, and wherein a side stop member is fixed relative to each of the base stop members, and wherein interference between the side stop members and the tracks restricts relative lateral movement between the base frame and the base assembly.

11. The furniture member of claim 8, wherein actuation of only the second linear actuator while the seatback frame is in the upright position to move the legrest mechanism from the retracted position to the extended position causes the seatback frame and the base frame to tilt rearward relative to the base assembly from the upright position to a pre-tilt position.

12. The furniture member of claim 11, further comprising a first switch controlling operation of the first actuator independently from the second actuator, a second switch controlling operation of the second actuator independently of the first actuator, and a third switch controlling simultaneous actuation of the first and second actuators.

13. A furniture member comprising:

a base assembly including a pair of rails extending parallel to each other between front and rear portions of the base assembly;

a frame assembly including a base frame, a seatback frame and a seat bottom frame, the seatback frame being rotatably coupled to the base frame, the seat bottom frame being movably coupled to the seatback frame such that rotation of the seatback frame causes corresponding movement of the seat bottom frame relative to the seatback frame and the base frame;

a tilt mechanism supporting the base frame and coupled to the seat bottom frame, the tilt mechanism including bearings that movably engage the rails such that rotation of the seatback frame relative to the base frame causes the bearings to move along the rails, thereby translating the base frame relative to the base assembly; and a pair of base stop members are fixedly attached to the base frame, the base stop members are spaced apart from the rails when the seatback frame is in a fully reclined position and abut the rails when the seatback frame is in an upright position, each of the base stop members including a side stop member fixed relative thereto, wherein interference between the side stop members and the rails restricts relative lateral movement between the base frame and the base assembly.

14. The furniture member of claim 13, wherein each of the rails includes a track and a stop plug at least partially received in a front end of the track.

15. The furniture member of claim 14, wherein the bearings contact the stop plugs when the seatback frame is in the fully reclined position.

16. The furniture member of claim 13, wherein each base stop member includes first and second legs forming an L-shaped profile, and wherein both of the first and second legs contacts the corresponding rail.

17. The furniture member of claim 13, wherein the base frame tilts relative to the base assembly as the base frame translates relative to the base assembly.

18. The furniture member of claim 13, further comprising a legrest mechanism that is movable between extended and retracted positions independently of movement of the seatback frame relative to the base frame.

19. The furniture member of claim 18, further comprising a first linear actuator and a second linear actuator, the first linear actuator powering movement of the tilt mechanism, the second linear actuator powering movement of the legrest mechanism.

20. The furniture member of claim 19, further comprising a first switch controlling operation of the first actuator independently from the second actuator, a second switch controlling operation of the second actuator independently of the first actuator, and a third switch controlling simultaneous actuation of the first and second actuators.

21. The furniture member of claim 19, wherein actuation of only the second linear actuator while the seatback frame is in the upright position to move the legrest mechanism from the retracted position to the extended position causes the seatback frame and the base frame to tilt rearward relative to the base assembly from the upright position to a pre-tilt position.

22. The furniture member of claim 19, wherein the first and second linear actuators are aligned with each other and with an axis that extends vertically upward from a support surface upon which the furniture member is situated for normal use, the axis being perpendicular to the support surface.

23. The furniture member of claim 22, wherein the first linear actuator powers rotation of the seatback frame relative to the base frame.

24. The furniture member of claim 23, wherein the first linear actuator powers movement of the seat bottom frame relative to the base frame.

25. A motion sofa comprising:

a plurality of seat sections mounted on first and second support members, each of the seat sections including:

a base assembly mounted to the first and second support members and including a pair of rails extending parallel to each other between front and rear portions of the base assembly, each of the rails including a track and a stop plug at least partially received in a front end of the track;

a frame assembly including a base frame, a seatback frame and a seat bottom frame, the seatback frame being rotatably coupled to the base frame, the seat bottom frame being movably coupled to the seatback frame such that rotation of the seatback frame causes corresponding movement of the seat bottom frame relative to the seatback frame and the base frame; and a tilt mechanism supporting the base frame and coupled to the seat bottom frame, the tilt mechanism including drive links and side plates that slidably engage the tracks such that rotation of the seatback frame relative to the base frame causes the drive links and side plates to slide along the tracks, thereby translating the base frame relative to the base assembly, each of the side plates including a bearing that contacts one of the stop plugs when the seatback frame is in a fully reclined position, wherein the tilt mechanism of each of the seat sections are movable independently of each other, wherein a pair of base stop members are fixedly attached to the base frame, the base stop members are spaced apart from the stop plugs when the seatback frame is in the fully reclined position and abut the stop plugs when the seatback frame is in an upright position.

26. The motion sofa of claim 25, wherein a side stop member is fixed relative to each of the base stop members, and wherein interference between side stop members and the tracks restricts relative lateral movement between the base frame and the base assembly.

27. The motion sofa of claim 26, wherein each base stop member includes first and second legs forming an L-shaped profile, and wherein both of the first and second legs contacts the corresponding stop plug.

28. The motion sofa of claim 25, wherein the base frame tilts relative to the base assembly as the base frame translates relative to the base assembly.

29. The motion sofa of claim 25, further comprising a legrest mechanism that is movable between extended and retracted positions independently of movement of the seatback frame relative to the base frame.

30. The motion sofa of claim 29, further comprising a first linear actuator and a second linear actuator, the first linear actuator powering movement of the tilt mechanism, the second linear actuator powering movement of the legrest mechanism.

31. The motion sofa of claim 30, wherein the first linear actuator powers rotation of the seatback frame relative to the base frame.

32. The motion sofa of claim 31, wherein the first linear actuator powers movement of the seat bottom frame relative to the base frame.

33. The motion sofa of claim 32, wherein the first and second linear actuators are aligned with each other and with an axis that extends vertically upward from a support surface upon which the furniture member is situated for normal use, the axis being perpendicular to the support surface.

34. The motion sofa of claim 33, wherein each base stop member includes first and second legs forming an L-shaped profile, and wherein both of the first and second legs contacts the corresponding stop plug, and wherein a side stop member is fixed relative to each of the base stop members, and wherein interference between the side stop members and the tracks restricts relative lateral movement between the base frame and the base assembly.

35. The motion sofa of claim 32, wherein actuation of only the second linear actuator while the seatback frame is in the upright position to move the legrest mechanism from the retracted position to the extended position causes the seatback frame and the base frame to tilt rearward relative to the base assembly from the upright position to a pre-tilt position.

36. The motion sofa of claim 35, further comprising a first switch controlling operation of the first actuator independently from the second actuator, a second switch controlling operation of the second actuator independently of the first actuator, and a third switch controlling simultaneous actuation of the first and second actuators.

37. A furniture member comprising:

a base assembly including a pair of rails extending parallel to each other between front and rear portions of the base assembly;

a frame assembly including a base frame, a seatback frame and a seat bottom frame, the seatback frame being rotatably coupled to the base frame, the seat bottom frame being movably coupled to the seatback frame such that rotation of the seatback frame causes corresponding movement of the seat bottom frame relative to the seatback frame and the base frame;

a tilt mechanism supporting the base frame and coupled to the seat bottom frame, the tilt mechanism including side plates that movably engage the rails such that rotation of the seatback frame relative to the base frame causes the side plates to move along the rails, thereby moving the base frame relative to the base assembly; and a pair of base stop members attached to the base frame, the base stop members are spaced apart from the rails when the seatback frame is in a reclined position and contact the rails when the seatback frame is in an upright position.

38. The furniture member of claim 37, wherein each base stop member includes first and second legs forming an L-shaped profile, and wherein both of the first and second legs contacts the corresponding rails, and wherein a side stop member is attached to each of the base stop members, and wherein interference between the side stop members and the rails restricts relative lateral movement between the base frame and the base assembly.

* * * * *